US005399076A

United States Patent [19]

Matsuda et al.

[11] Patent Number: 5,399,076

[45] Date of Patent: Mar. 21, 1995

[54] ROLLING PISTON COMPRESSOR

[75] Inventors: Mikio Matsuda; Mitsuo Inagaki; Hiroshi Ogawa; Hideaki Sasaya, all of Okazaki, Japan

[73] Assignees: Nippondenso Co., Ltd., Kariya; Nippon Soken Inc., Nishio, both of Japan

[21] Appl. No.: 41,246

[22] Filed: Apr. 1, 1993

[30] Foreign Application Priority Data

Apr. 1, 1992 [JP] Japan ..... 4-079653
Sep. 28, 1992 [JP] Japan ..... 4-258098
Dec. 17, 1992 [JP] Japan ..... 4-337520

[51] Int. Cl.[6] ..... F04C 23/00
[52] U.S. Cl. ..... 418/6; 418/11; 418/59
[58] Field of Search ..... 418/6, 11, 13, 59

[56] References Cited

U.S. PATENT DOCUMENTS 2,759,664 8/1956 Auwärter ..... 418/6
5,015,161 5/1991 Amin et al. ..... 418/6

FOREIGN PATENT DOCUMENTS 0917744 9/1954 Germany ..... 418/6
3536714 4/1986 Germany ..... 418/6

OTHER PUBLICATIONS

"Essences of Air Conditioning Device for an Automobile", May 20, 1989, Tesudo Nipponsha.

*Primary Examiner*—Richard E. Gluck
*Assistant Examiner*—Charles G. Freay
*Attorney, Agent, or Firm*—Cushman, Darby & Cushman

[57] ABSTRACT

A rolling piston type compressor of a simplified design having a single rolling piston, capable of reducing a variation in torque. The compressor has a housing in which a rolling piston 42 is arranged so that an orbital movement of the rolling piston is obtained about the axis of a crankshaft 5, so that a first operating chamber 40 is formed between the rolling piston 42 and the housing. A cylindrical pillar 47 which is stationary is arranged in the rolling piston, so that a second operating chamber is formed between the rolling piston and the pillar. The medium compressed in the first operating chamber is introduced into the second operating chamber for obtaining two step compression.

24 Claims, 29 Drawing Sheets

θ=0, 360°

θ=90°

θ=270°

θ=180°

ROLLING PISTON COMPRESSOR

BACKGROUND OF THE INVENTION

1. Field of the Invention

The present invention relates a rolling cylinder type compressor suitably used for a compressor for a refrigerant in an air conditioning apparatus for an automobile.

2. Description of Related Art

A rolling cylinder type compressor is known which includes a cylinder block defining a cylinder bore of a circular cross-sectional shape, and a rolling piston of cylindrical shape which is arranged in the cylinder bore, the rolling piston being connected to a crank member which is eccentric to the axis of the crankshaft, which conforms to the axis of the cylinder bore, so that an orbital movement of the rolling piston inside the housing is obtained by which the rolling piston is in contact, at its outer cylindrical surface, with an inner cylindrical bore.

A spring urged vane is provided at the outer periphery of the rolling piston so that the vane is contacted at its outer end with the inner surface of the cylinder bore. The bore divides the operating chamber in the cylinder into two sections, one of which is connected to the intake port for introduction of the medium to be compressed, and the other of which is connected to the outlet port for discharge of the compressed medium.

The orbital movement of the rolling piston causes the volumes of the sectioned chambers to be continuously varied, so that the medium is compressed and sucked into the operating chamber at its first section, while the compressed medium is discharged to the outlet port.

Prior art construction of a rolling piston compressor suffers from a drawback in that only one cycle can be obtained by one complete orbital movement of the rolling piston, which causes the variation in the driving torque to be increased, causing noise or vibration to be increased, which makes passengers feel uncomfortable on one hand, and shortens the service life of the compressor.

SUMMARY OF THE INVENTION

The present invention aims to overcome the above mentioned drawback in the prior art.

According to the present invention a rolling piston type compressor is provided, comprising:

(a) a housing defining a circular cylinder bore defining an inner cylindrical surface;

(b) a shaft having an axis of elongation rotatably supported by the housing, the shaft having a crank member which is eccentric with respect to the axis of the shaft;

(c) a circular cylindrical pillar which is fixed to the housing and which has an axis of elongation which coincides with the axis of the shaft, the pillar forming an outer cylindrical surface;

(d) a rolling piston of a circular tubular shape having an axis of elongation, the rolling piston being connected rotatably to the crank member of the shaft so that an orbital movement of the rolling piston is obtained about the axis of the shaft, the rolling piston having inner and outer circular cylindrical surfaces, which, during the orbital movement of the rolling piston, remain in contact, respectively, with the outer cylindrical surface of the pillar and the inner cylindrical surface of the housing, so that first and second operating chambers are created between the rolling piston and the housing and between the rolling piston and the pillar, respectively, and so that the volumes of the chambers are continuously varied during the orbital movement of the rolling piston;

(e) first vane means for dividing the first chamber into first and second section so that, upon the orbital movement of the rolling piston, the volume of the first section of the first chamber increases while volume of the second section of the first chamber decreases;

(f) second vane means for dividing the second chamber into first and second sections, so that, upon the orbital movement of the rolling piston, the volume of the first section of the second chamber increases while volume of the second section of the second chamber decreases;

(g) an intake port opened to the first section of one of the first and second chambers for introducing a medium to be compressed thereinto;

(h) an intermediate pressure chamber connected to the second section of one chamber with the first section of the other chamber for receiving the compressed medium thereat, and;

(i) an outlet pressure chamber for connecting the second section of the other chamber for receiving the medium compressed in the other chamber.

BRIEF EXPLANATION OF ATTACHED DRAWINGS

FIG. 1 is a longitudinal cross-sectional view of a first embodiment of a rolling piston compressor according to the present invention.

FIG. 2-(A) is a cross-sectional view taken along line 2—2 in FIG. 1, when the rolling piston is at a bottom dead center position.

FIG. 2-(B) is similar to FIG. 2-(A) but when the rolling piston is at a top dead center position.

FIGS. 5(*a*), 5(*b*), 5(*c*) and 5(*d*) illustrate the operation of the compressor according to the present invention, which show different phases during one complete rotation of the rolling piston about the axis of the shaft.

Figure 6A:
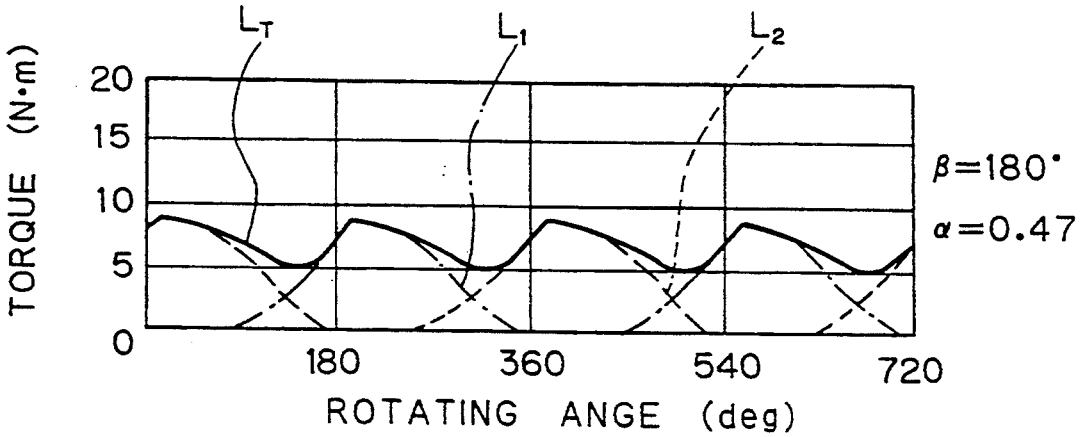
Figure 6B:
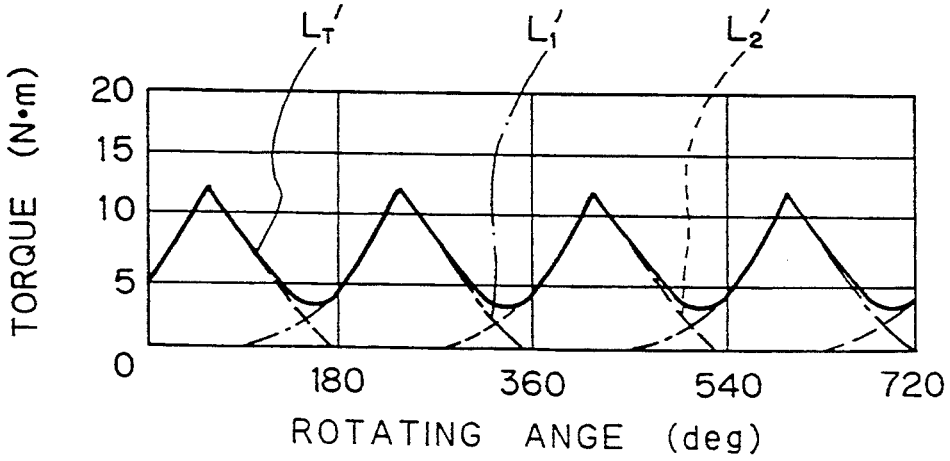
Fig. 6(B) (PRIOR ART)

FIGS. 6-(A) and (B) show a relationship between the rotating angle and the torque for the present invention and the prior art, respectively.

Figure 7:
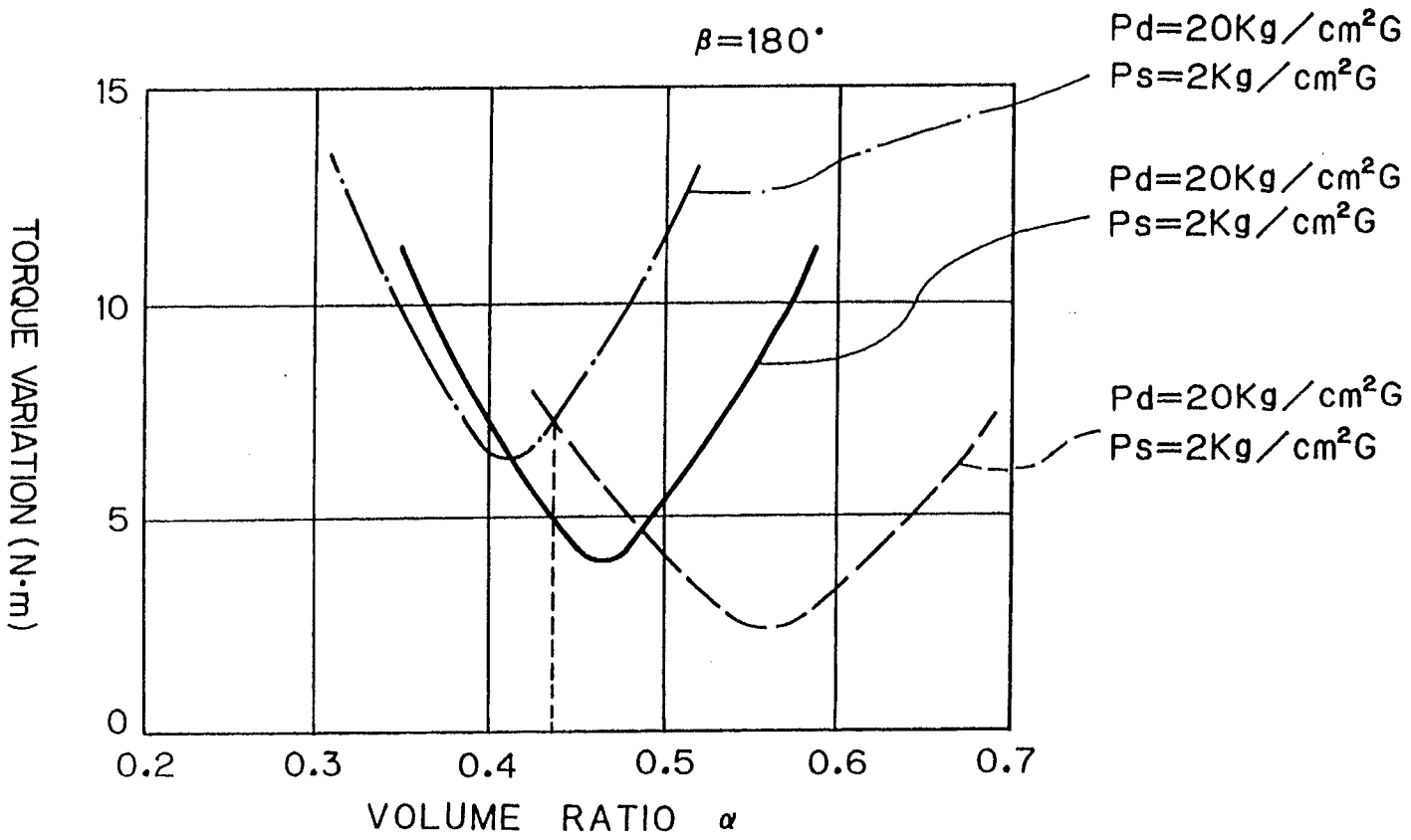

FIG. 7 shows relationships between the chamber volume ratio and the variation in torque according to the present invention.

Figure 8:
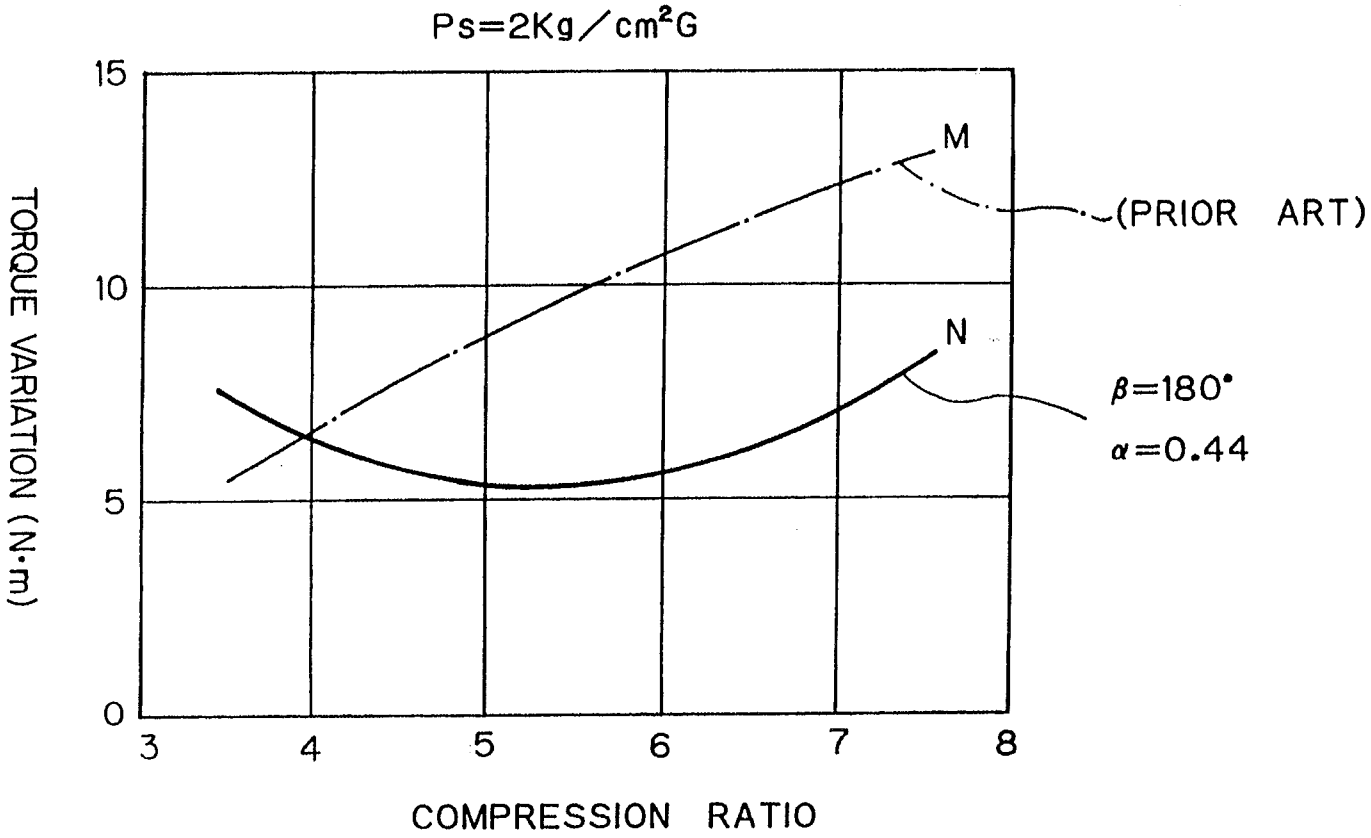

FIG. 8 shows the relationship between the compression ratio and the variation in torque according to the present invention.

Figure 9:
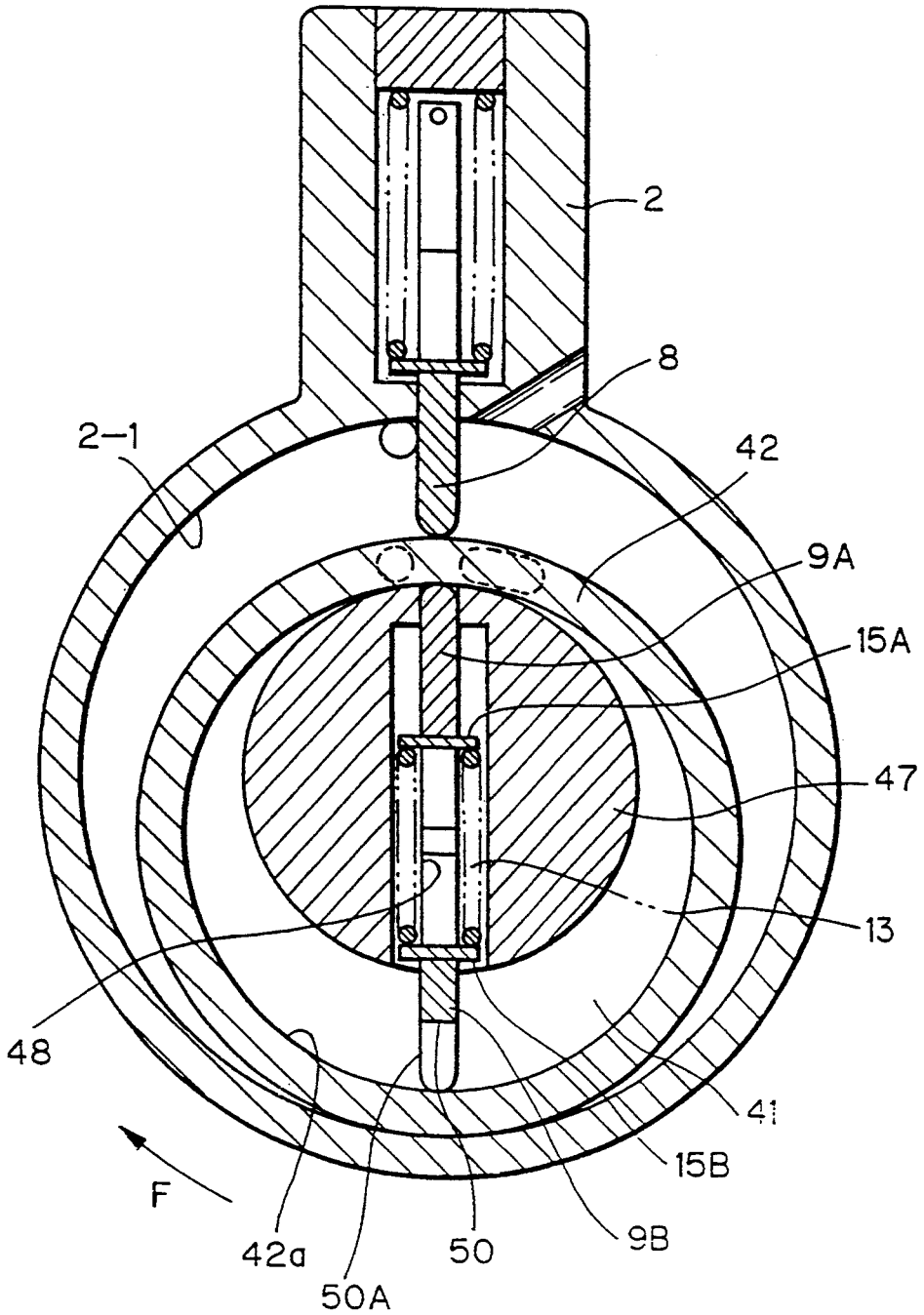

FIG. 9 is a transverse cross-sectional view of the compressor according to the second embodiment of the present invention.

Figure 10:
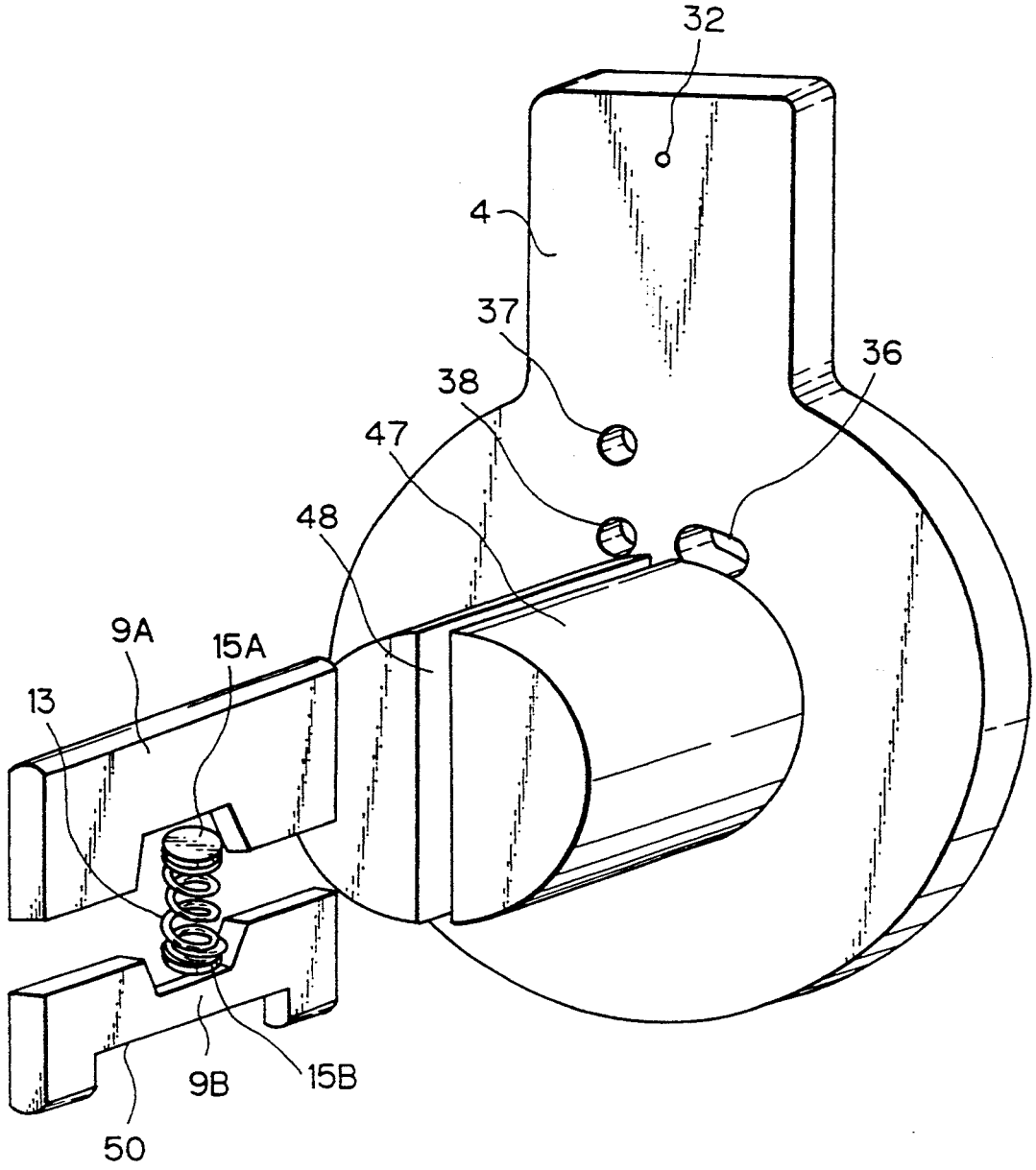

FIG. 10 is dismantled, partial schematic perspective view of the compressor in FIG. 9, focusing on the end plate, pillar member, and vanes.

Figure 11:
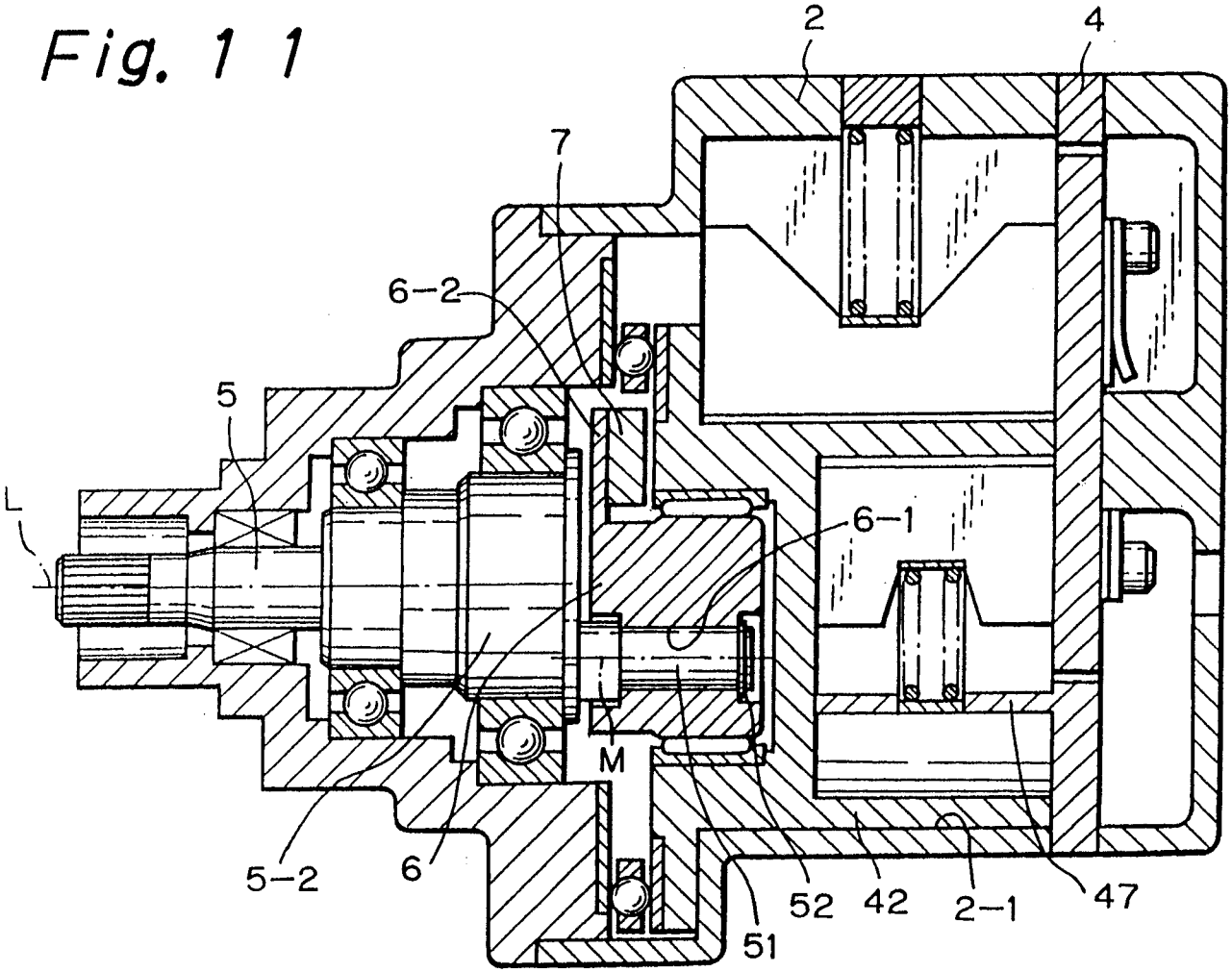

FIG. 11 is a transverse cross-sectional view of the compressor according to the third embodiment of the present invention.

Figure 12:
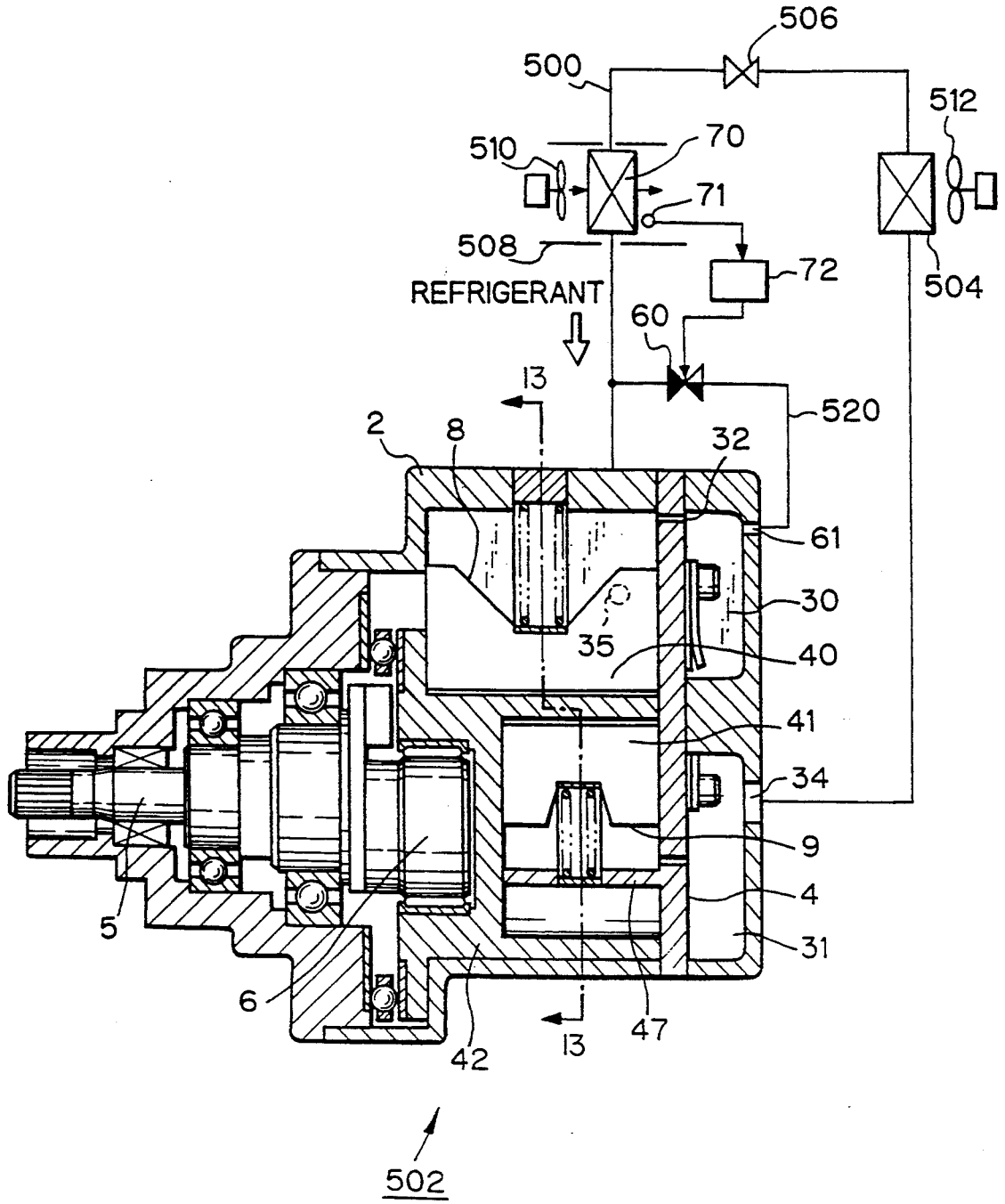

FIG. 12 is a longitudinal cross-sectional view of the compressor according to the fourth embodiment of the present invention.

Figure 13:
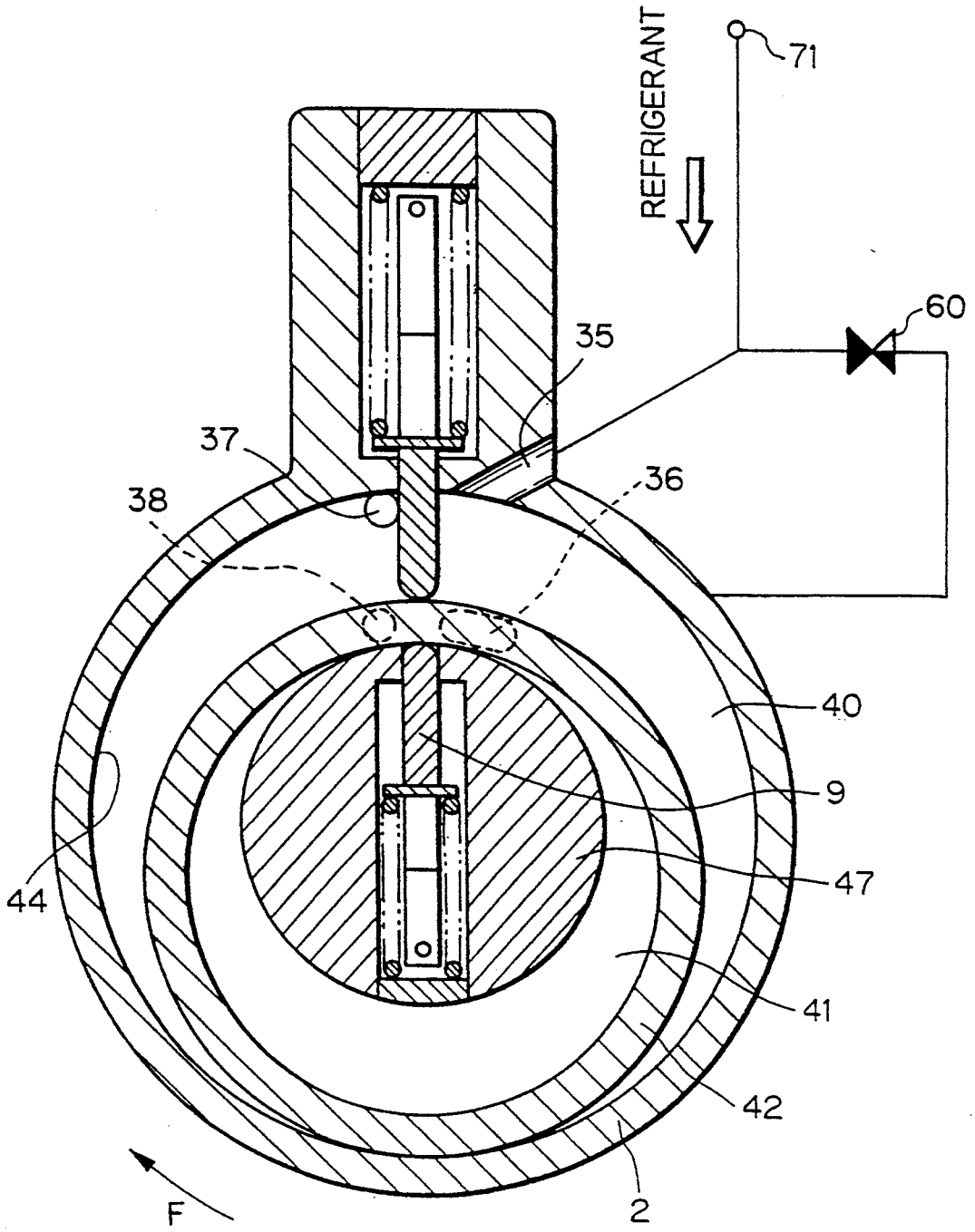

FIG. 13 is a cross-sectional view taken along line 13—13 in FIG. 12.

Figure 14:
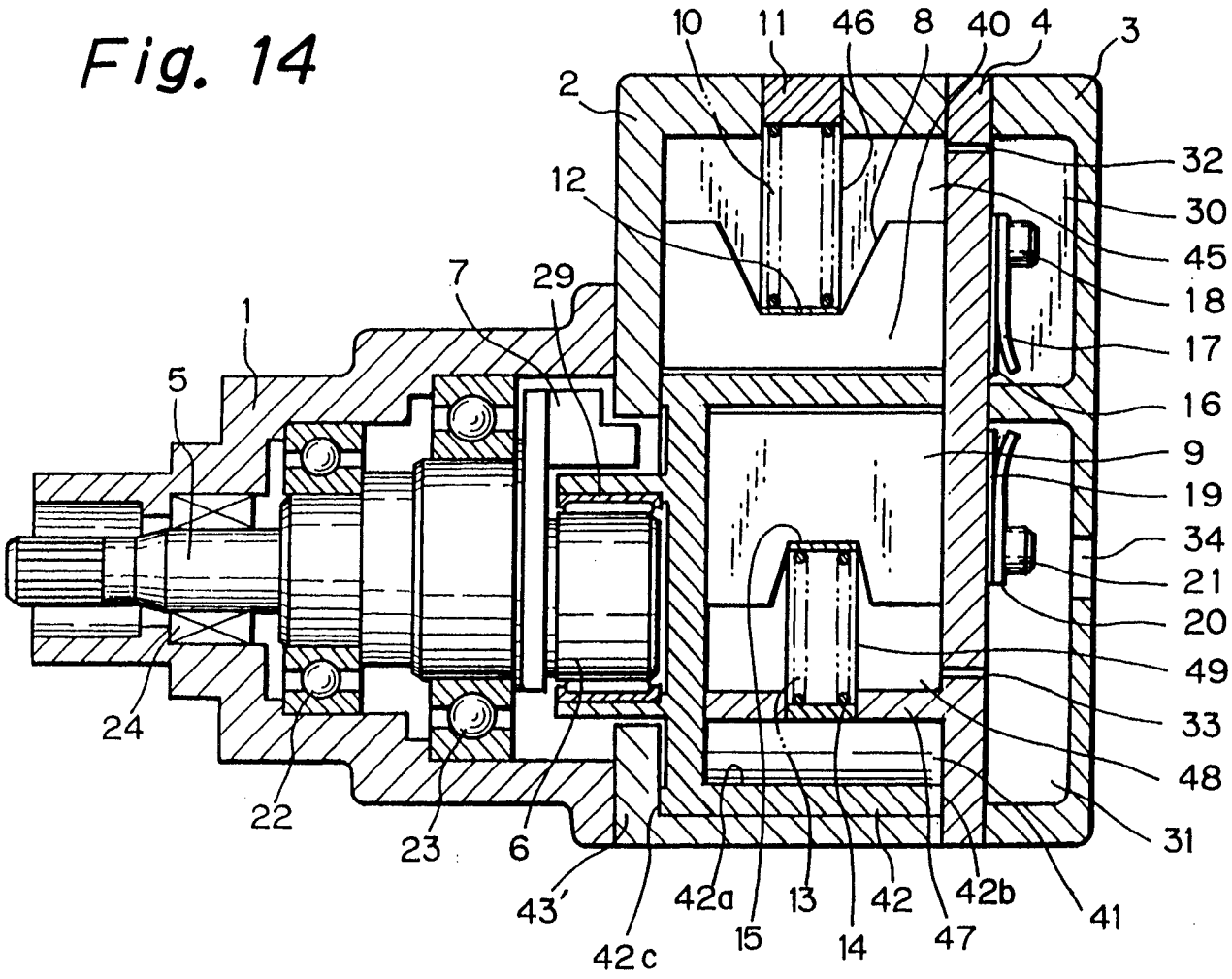

FIG. 14 is a longitudinal cross-sectional view of the compressor according to the 5th embodiment of the present invention.

Figure 15:
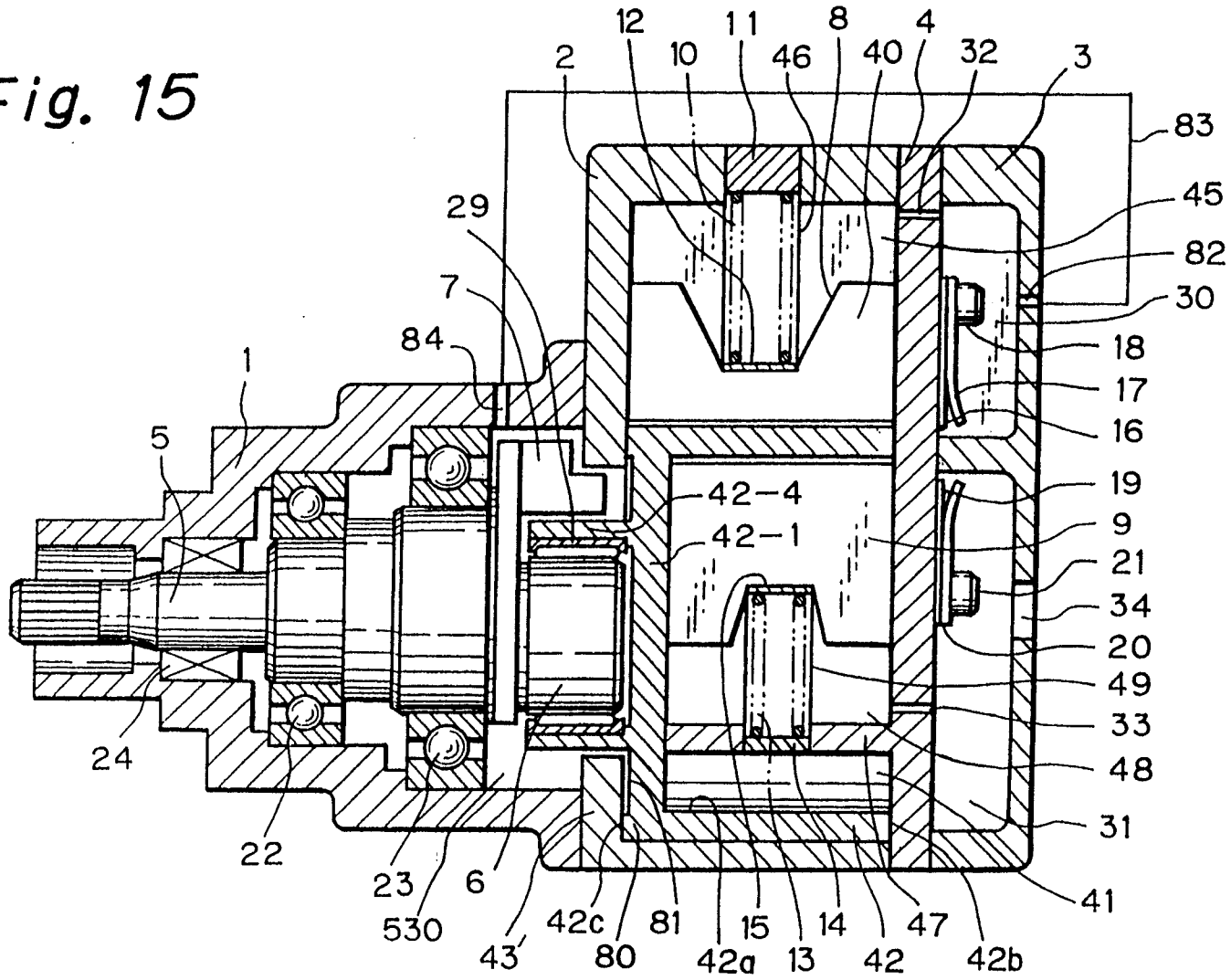

FIG. 15 is a longitudinal cross-sectional view of the compressor according to the 6th embodiment of the present invention.

Figure 16:
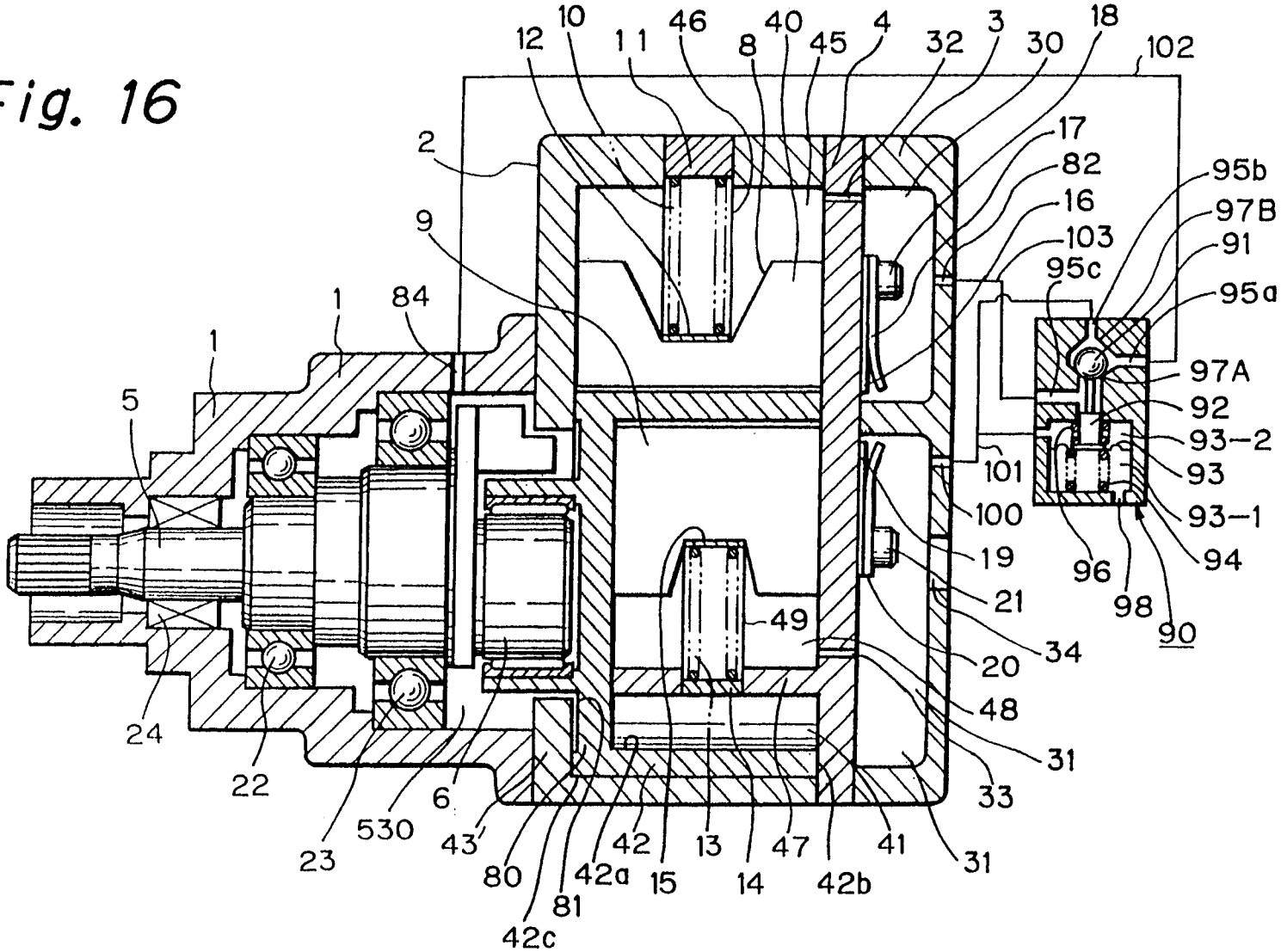

FIG. 16 is a longitudinal cross-sectional view of the compressor according to the 7th embodiment of the present invention.

Figure 17:
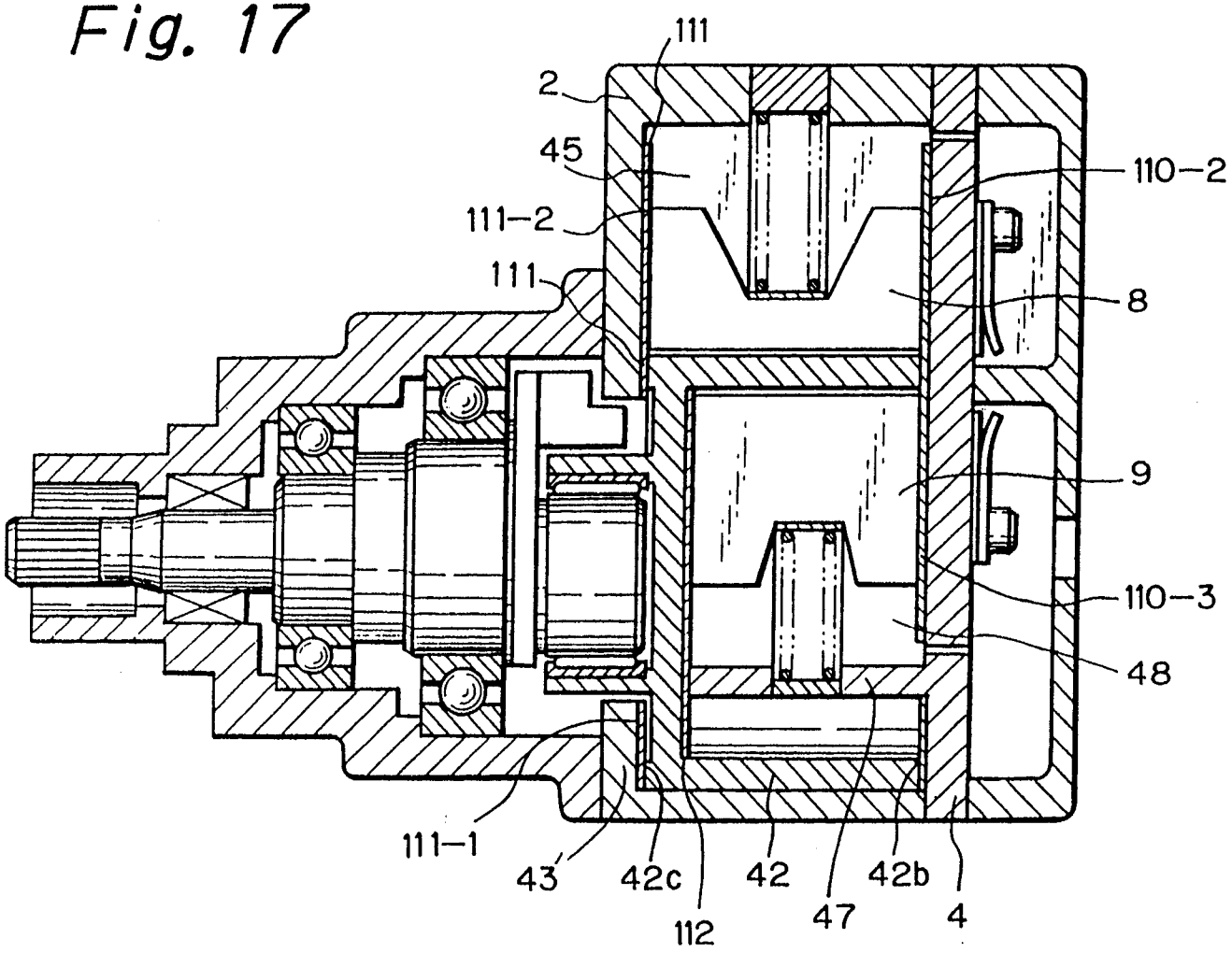

FIG. 17 is a longitudinal cross-sectional view of the compressor according to the 8th embodiment of the present invention.

Figure 18:
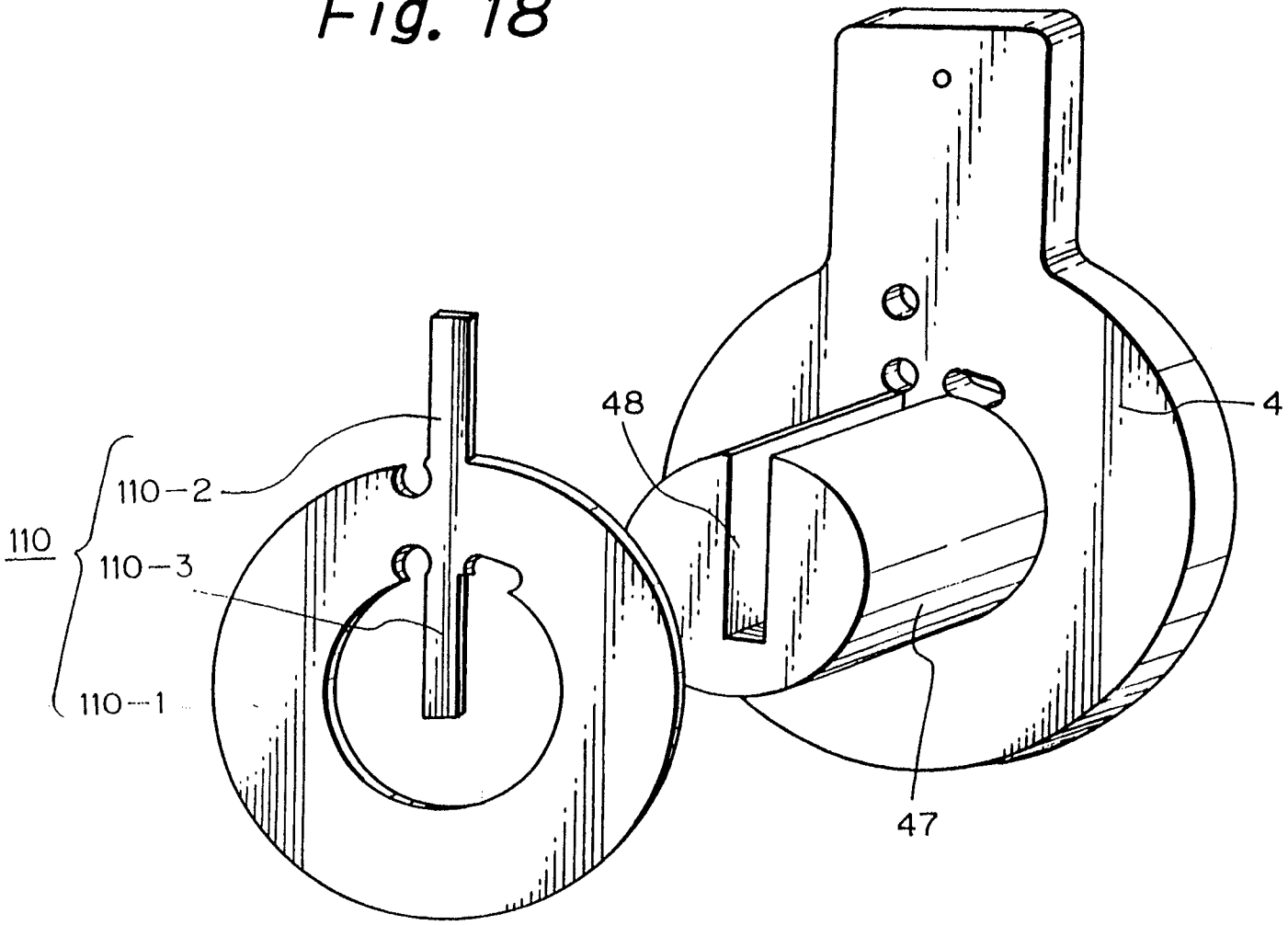
Figure 19:
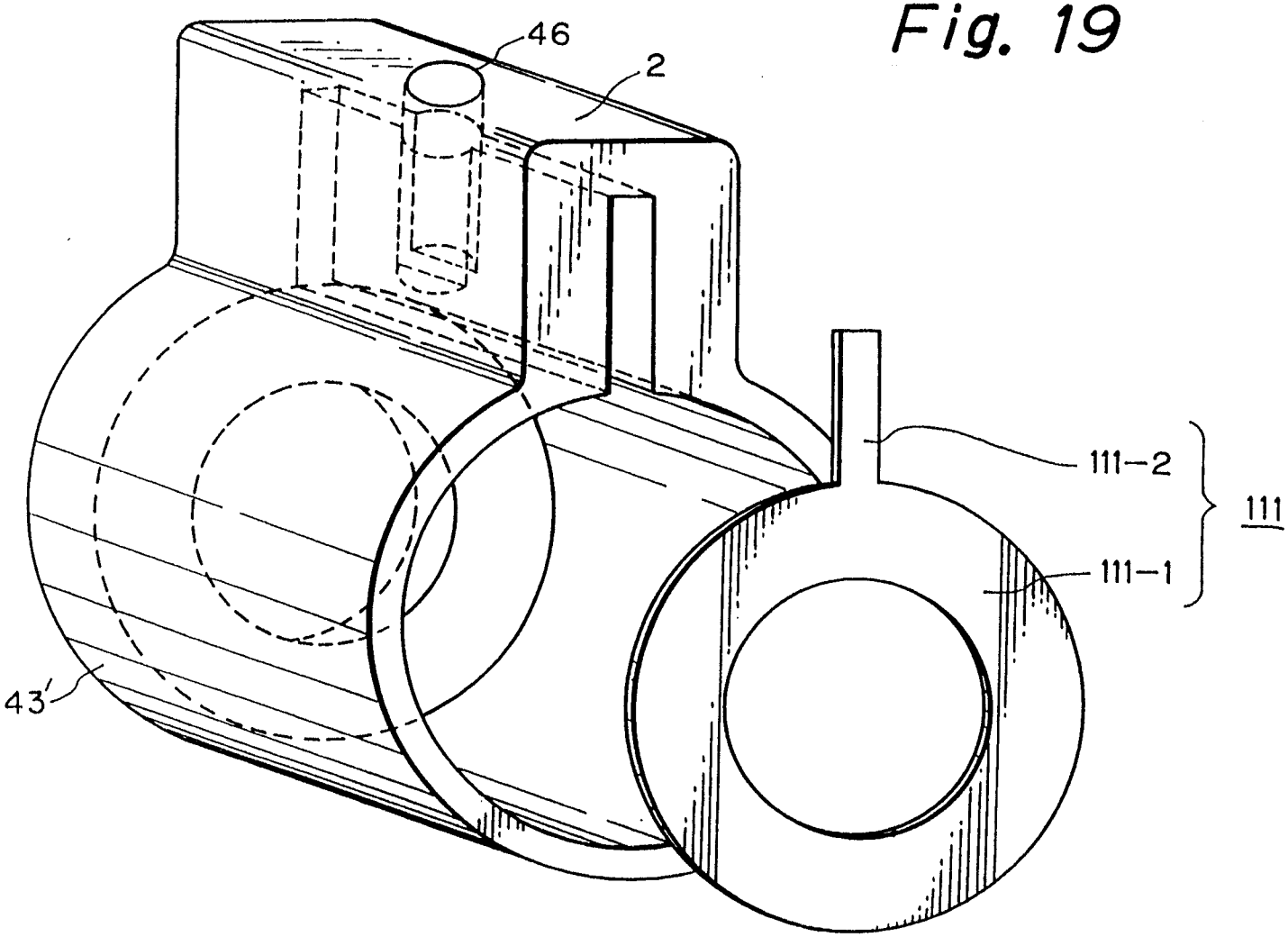

FIG. 18 is dismantled, partial schematic perspective view of the compressor in FIG. 17 focusing on the end plate, pillar member, and a sliding member. FIG. 19 is dismantled, partial schematic perspective view of the compressor in FIG. 17 focusing on the middle housing and a sliding member.

Figure 20:
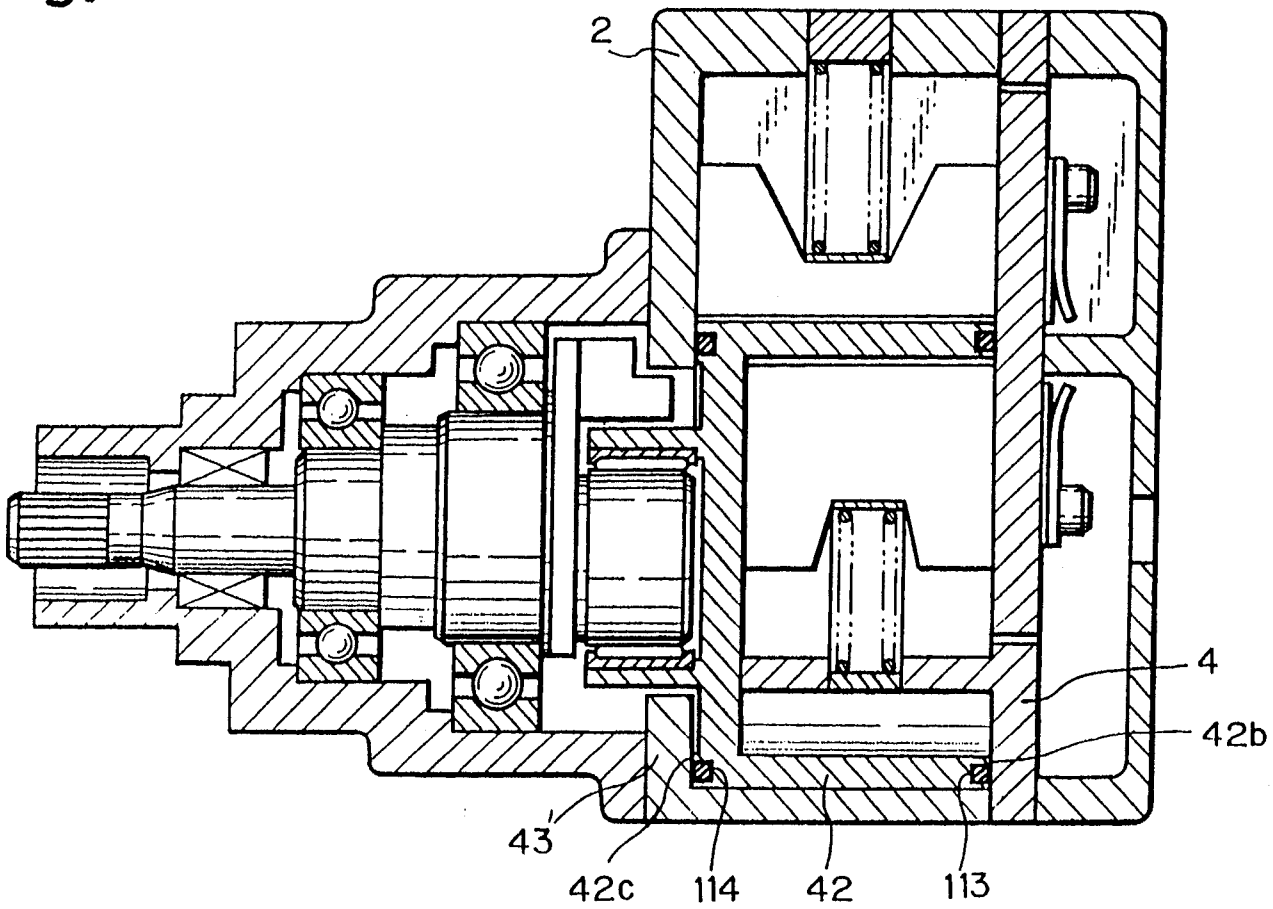

FIG. 20 is a longitudinal cross-sectional view of the compressor according to the 9th embodiment of the present invention.

Figure 21:
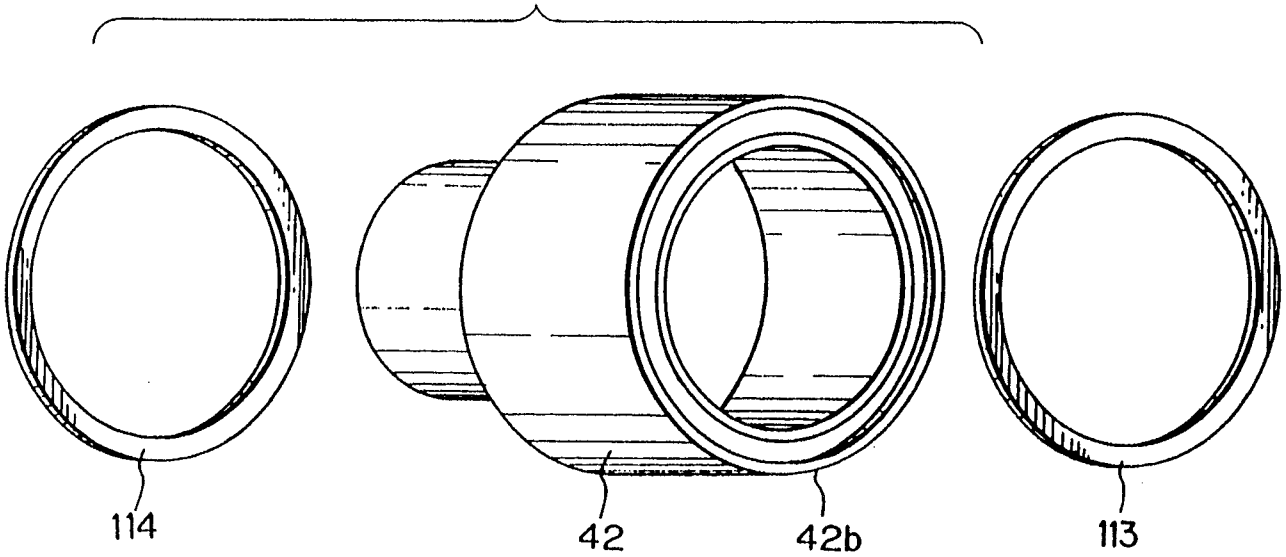

FIG. 21 is a dismantled, perspective view of a rolling piston and seal rings in the embodiment in FIG. 20.

Figure 22:
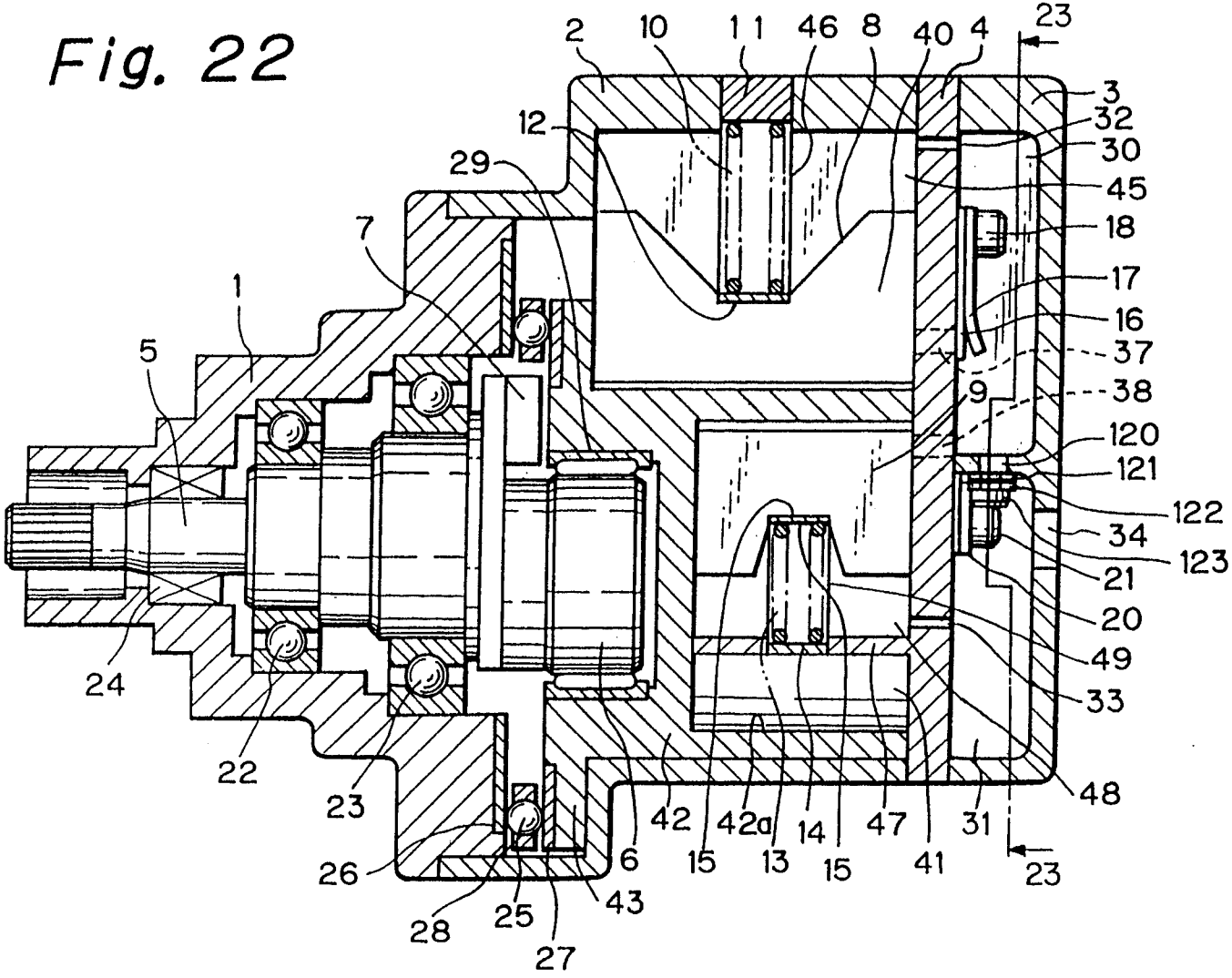

FIG. 22 is a longitudinal cross-sectional view of the compressor according to the 10th embodiment of the present invention.

Figure 23:
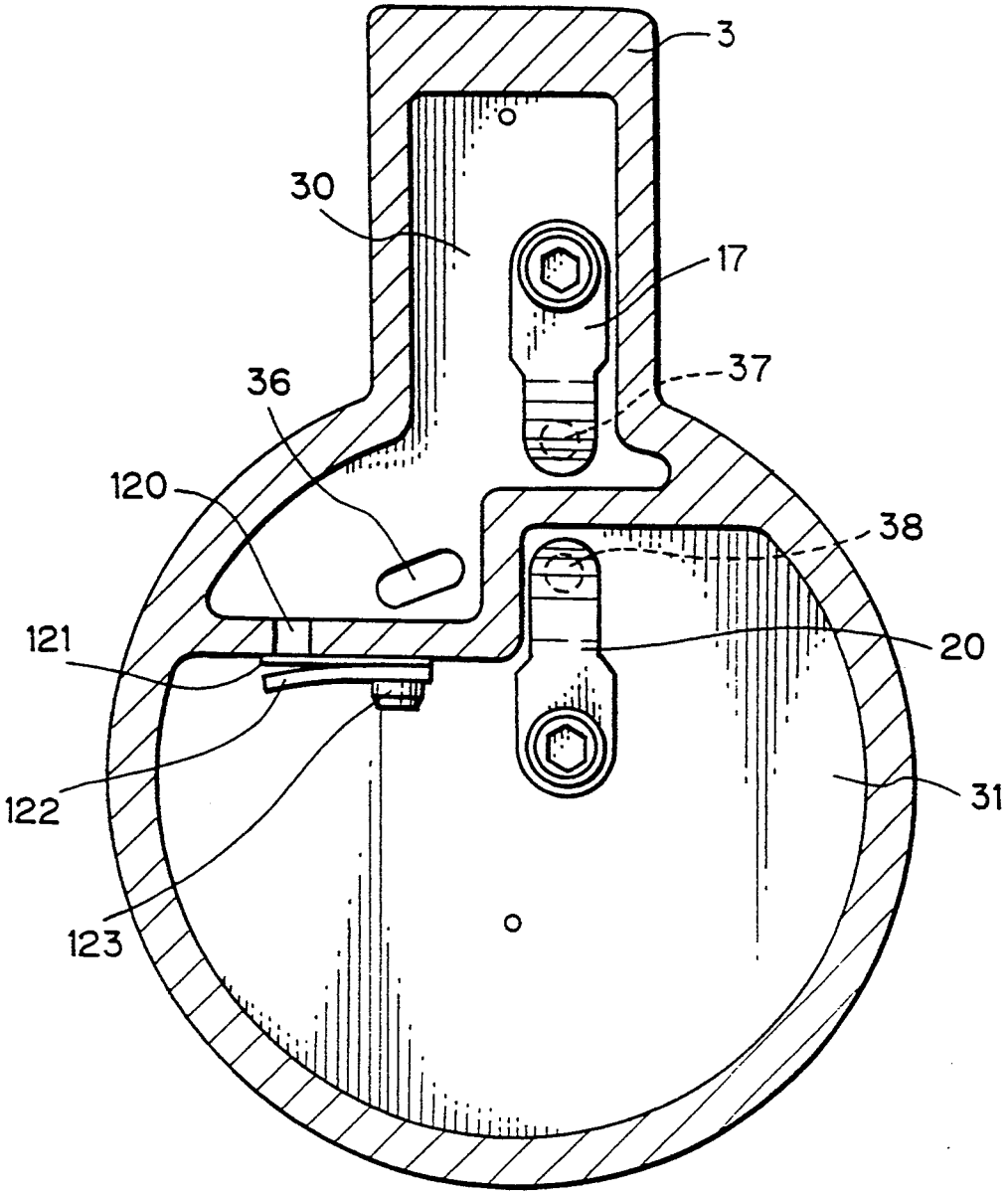
Figure 24:
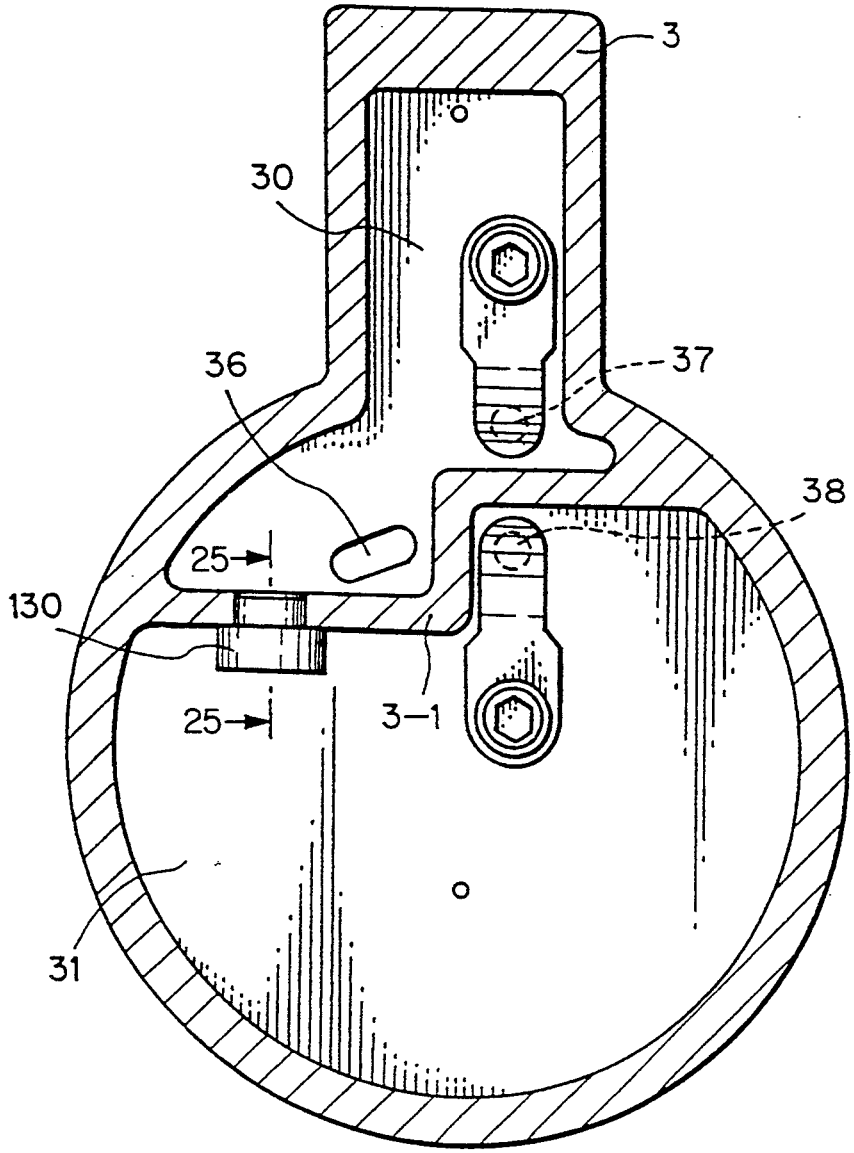

FIG. 23 is a cross-sectional view taken along line 23—23 in FIG. 24.

FIG. 24 is similar to FIG. 23 but is directed to the 11th embodiment of the present invention.

Figure 25:
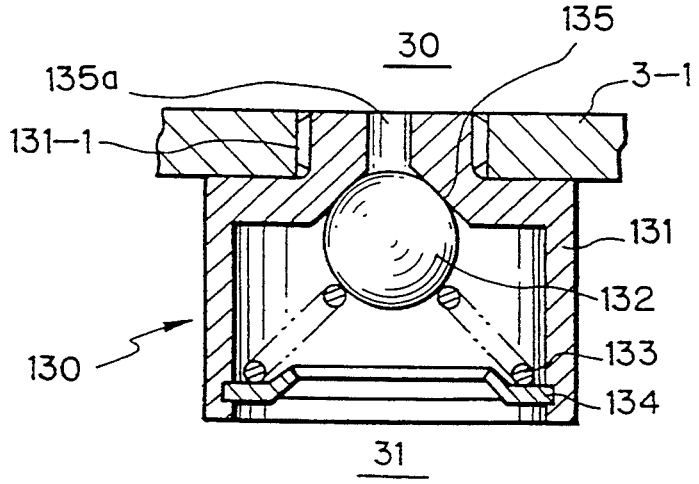

FIG. 25 is an enlarged view of a check valve in FIG. 24 taken along line 25—25.

Figure 26:
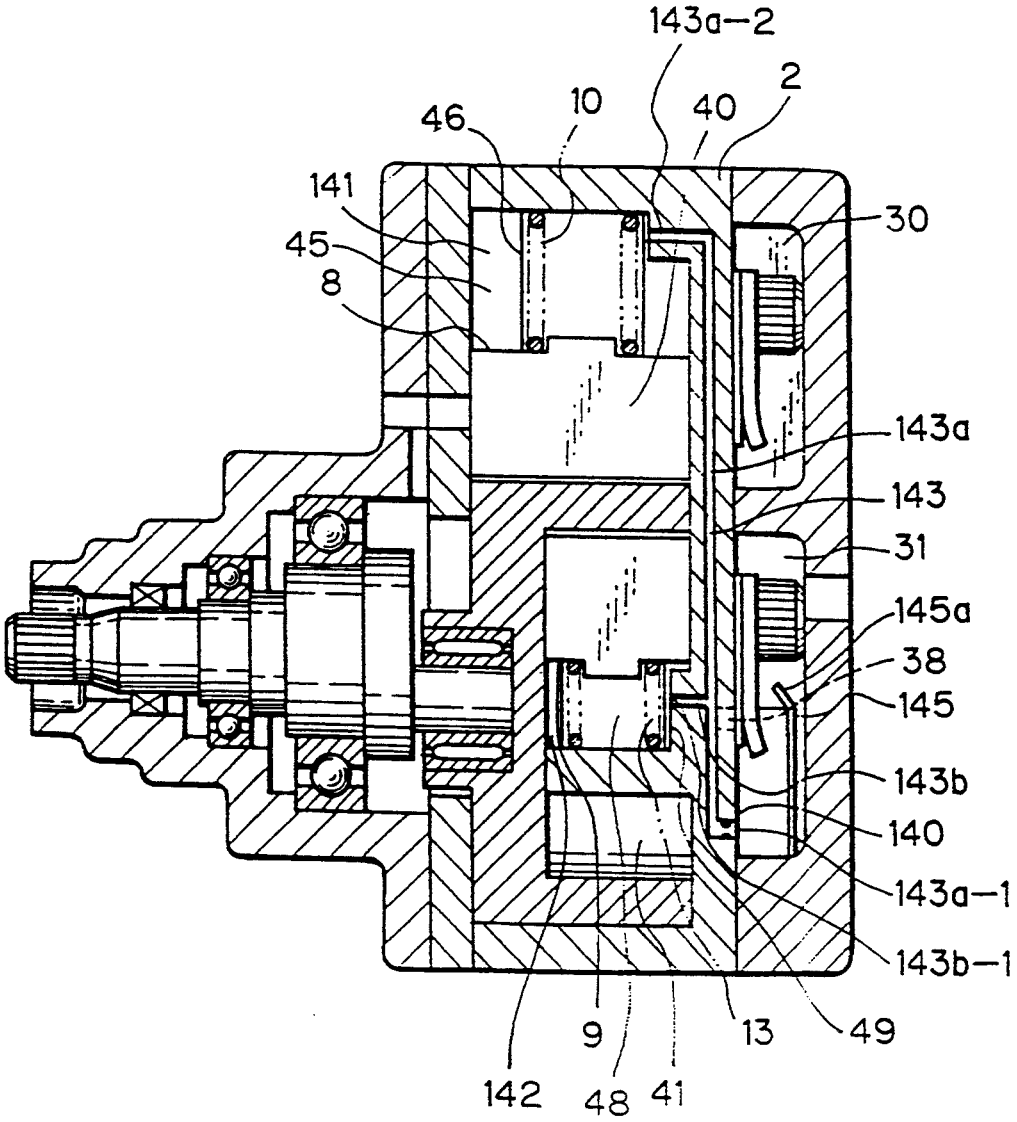

FIG. 26 is a longitudinal cross-sectional view of the compressor according to the 12th embodiment of the present invention.

Figure 27:
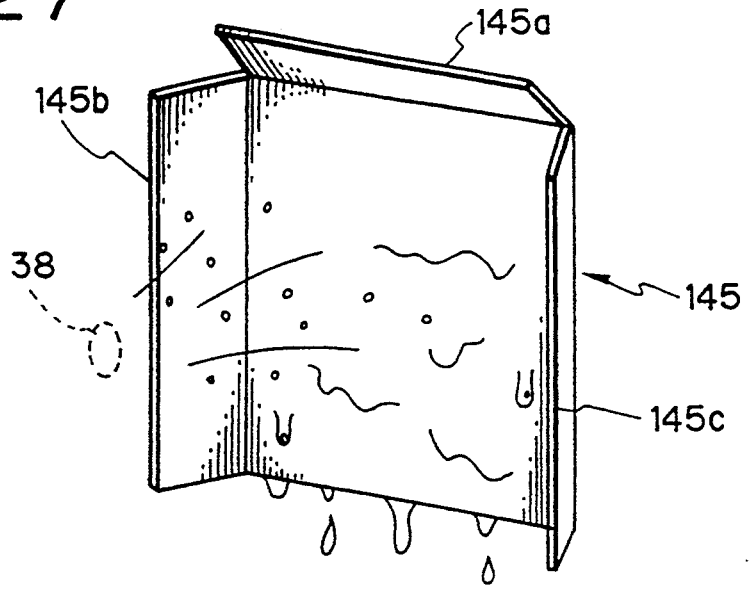

FIG. 27 is a schematic, perspective view of a separator plate in FIG. 26.

Figure 28:
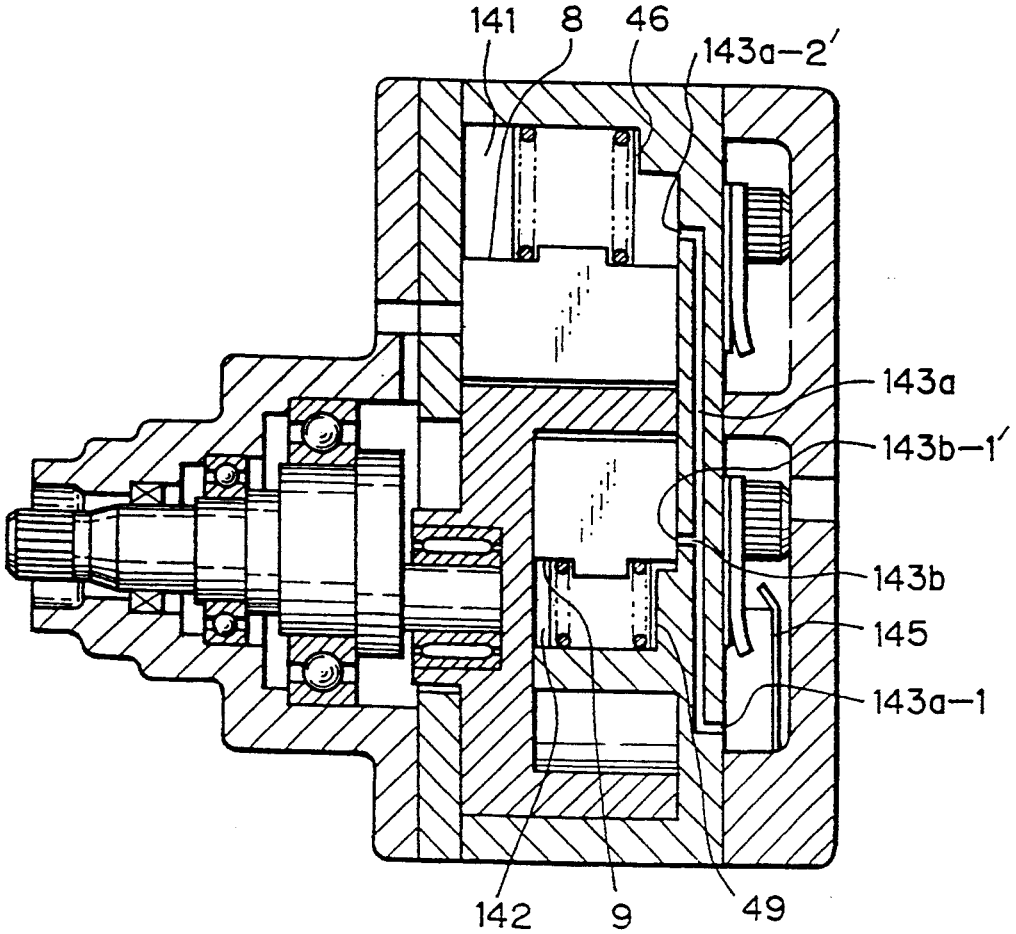

FIG. 28 is a longitudinal cross-sectional view of the compressor according to the 13th embodiment of the present invention.

Figure 29:
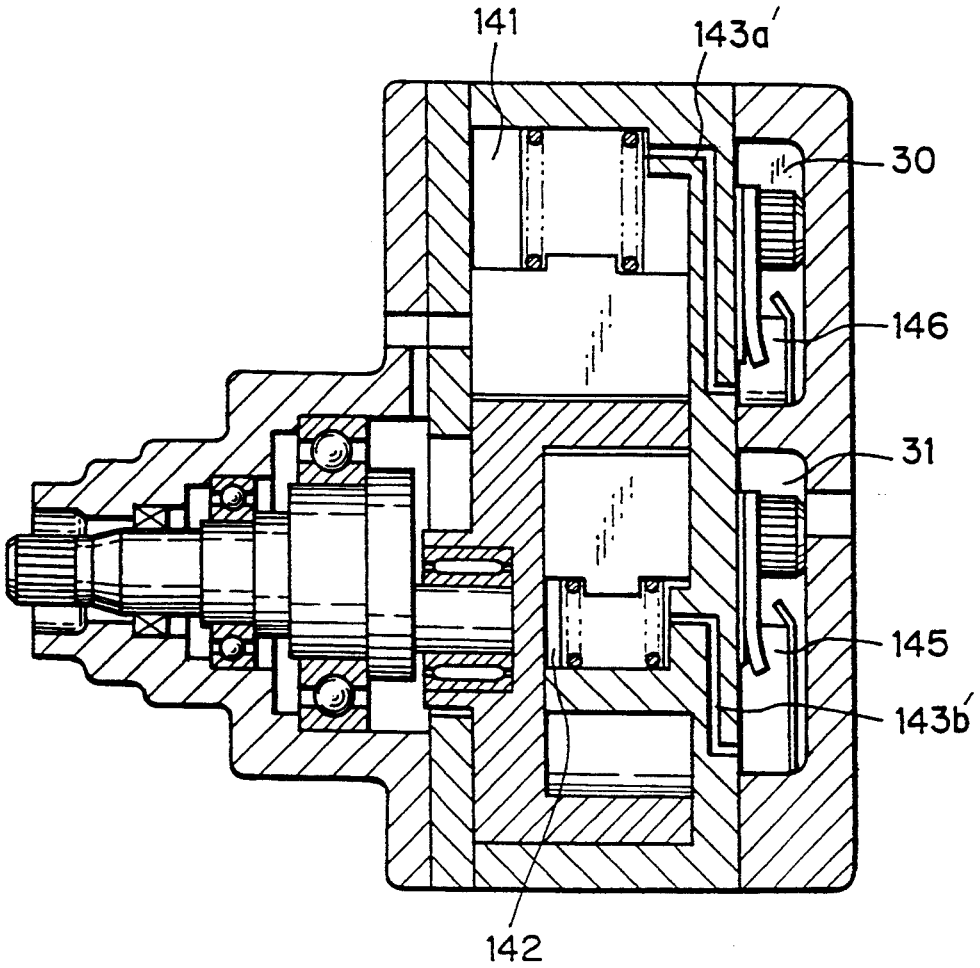

FIG. 29 is a longitudinal cross-sectional view of the compressor according to the 14th embodiment of the present invention.

Figure 30:
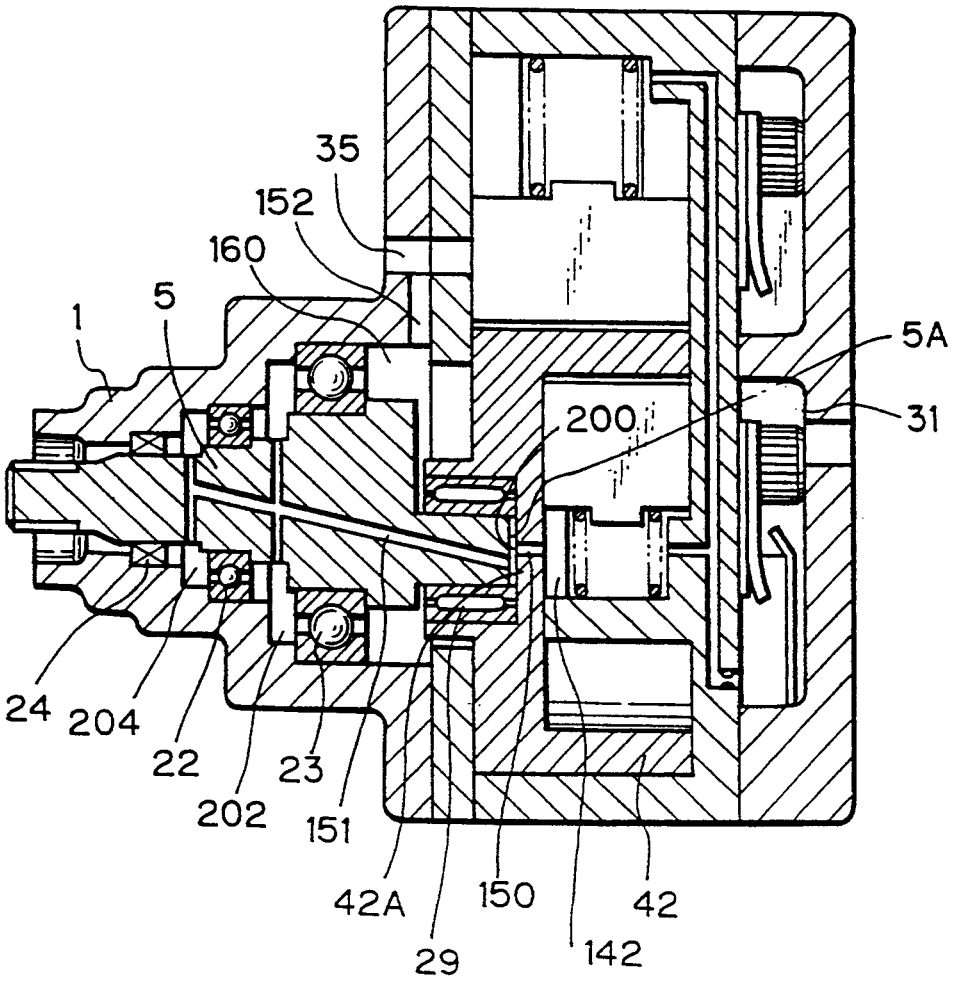

FIG. 30 is a longitudinal cross-sectional view of the compressor according to the 15th embodiment of the present invention.

DESCRIPTION OF PREFERRED EMBODIMENTS

Now, a first embodiment of the present invention will be explained with reference to FIGS. 1 to 4, wherein it is used as a refrigerant compressor for an automobile. The compressor includes a front housing 1, a middle housing 2, a rear housing 3, and an end plate 4. A crankshaft 5 has axially spaced portions 5-1 and 5-2 of different diameters, on which ball bearings 22 and 23 are provided, respectively, so that the crankshaft 5 is rotatably supported by the front housing 1. The crankshaft 5 has an outer end 5-3 which is outwardly projected out of the front housing 1, and to which end an electromagnetic clutch (not shown) is provided for selectively connecting a rotational movement from an internal combustion engine (not shown) to the crankshaft 5.

The crankshaft 5 has, at an inner end, a crank member 6 which is integrally formed with respect to the remaining part and which has an axis which is eccentric to the axis of the rotation of the crankshaft 5. Connected to the crank member 6 is a rolling piston 42 of substantially tubular shape, with a flange 43. The rolling piston 42 forms therein an inner partition wall 42-1, so that a first outwardly opened cylindrical recess 42-2 of smaller diameter is formed on one side of the partition wall 42-1, to which recess 42-2 the crank member 6 is fitted via a bearing member 29. As a result, a rotational movement applied to the crankshaft 5 causes the crank member 6 to be rotated about the rotating axis L of the shaft 5. Namely, an orbital movement of the rolling piston 42 is obtained when the shaft 5 is rotated. A second outwardly opened cylindrical recess 42-3 of a larger diameter is formed on the other side of the partition wall 42-1.

The crankshaft 5 is, at a location diametrically opposite the crank member 6, provided with a balance weight 7 which is for balancing the eccentric crank member 6 and the rolling piston 42 connected thereto. At the portion axially outward of the bearing 5-1, a seal member 24 is provided for preventing refrigerant and lubricant from being leaked.

A ring shaped plate 26 is fixedly arranged on the inner end wall of the housing 1. Arranged axially spaced apart from the ring shaped plate 26 is another ring shaped plate 27 which is fixedly connected to an end wall of a flange 43 of the rolling piston 42. Arranged between the ring shaped plates 26 and 27 is a plurality of circumferentially spaced balls 25 and a retainer 28 for holding the balls 25, so that a thrust force as generated in the rolling piston 42 is received.

Figure 2A:
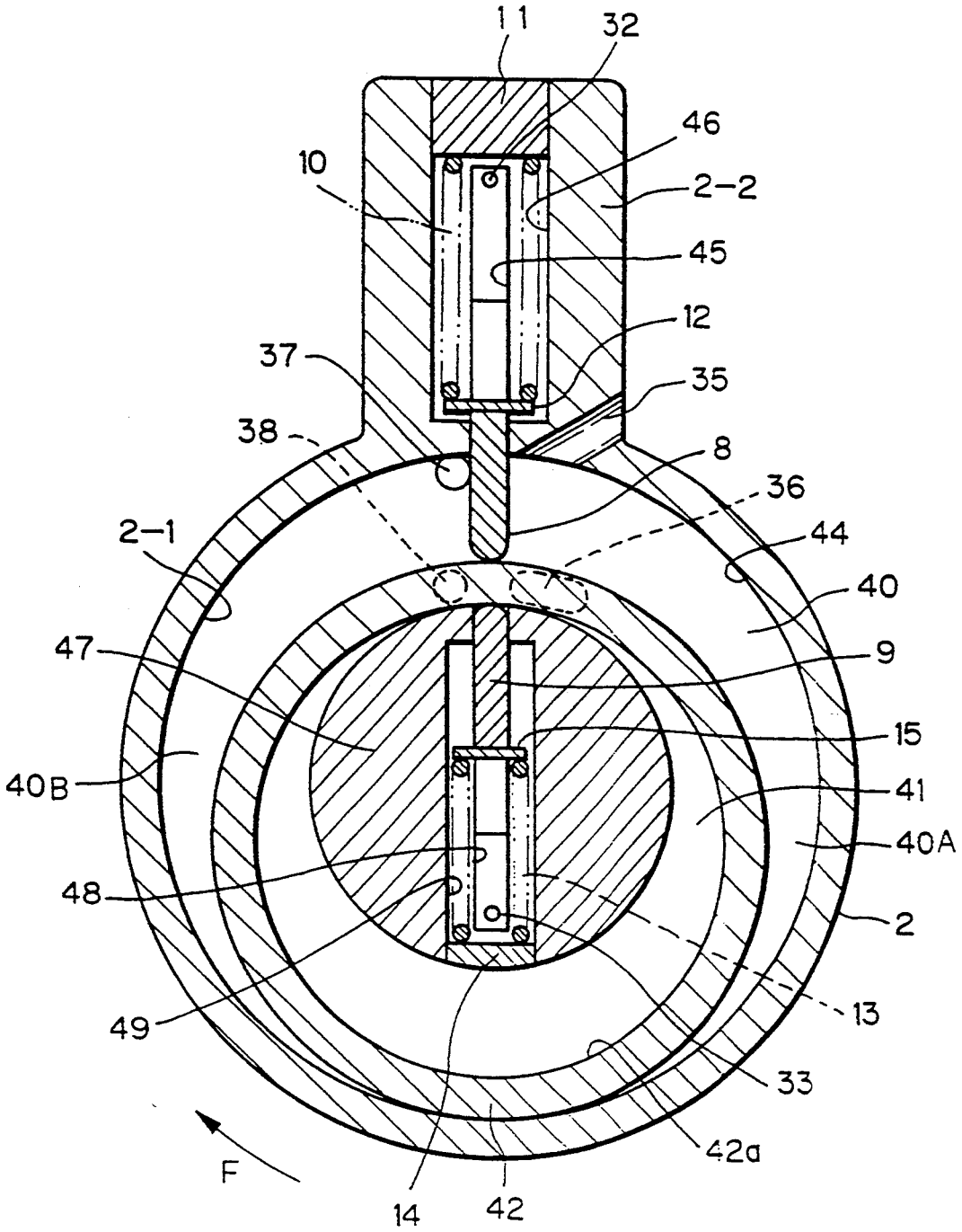
Figure 2B:
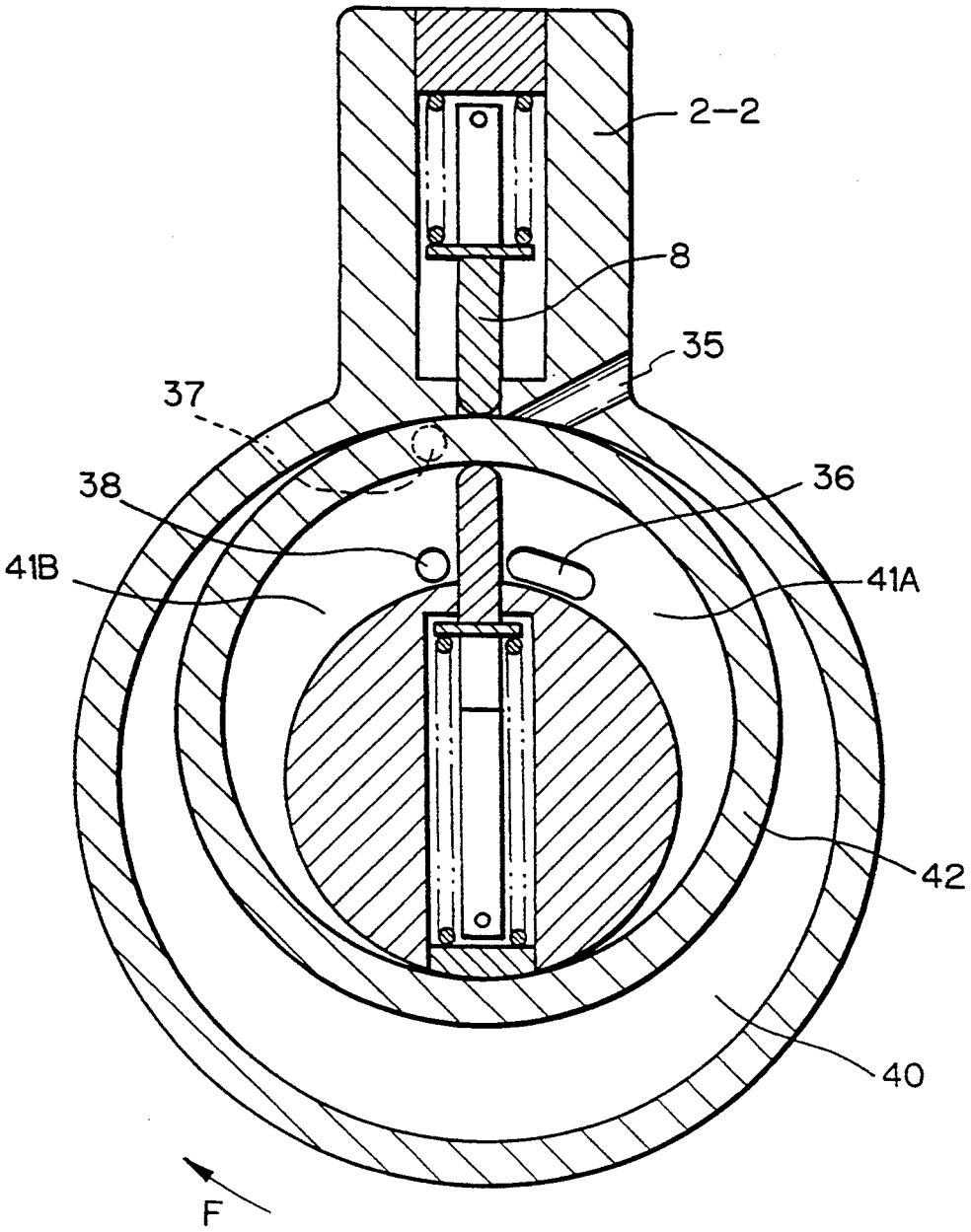

The middle housing 2, which is connected to the front housing 1 by means of bolts (not-shown) and which is connected to the end plate 4 and the rear housing 3 by means of bolts (not shown), forms a cylinder bore 2-1 of circular cross-sectional shape for storing therein the rolling piston 42. As shown in FIG. 2-(*a*), a first operating chamber 40 is delimited by means of the front housing 1, the middle housing 2, the end plate 4 and the rolling piston 42. The end plate 4 is, at a side facing the rolling piston 42, formed integrally with a pillar portion 47 of a circular cross-sectional shape extending axially toward the second cylindrical recess 42-3. The pillar portion 47 has an axis of elongation which conforms to the rotating axis L of the crankshaft 5. As shown in FIG. 2-(*a*), a second operating chamber 41 is delimited between the rolling piston 42, the end plate 4, and the cylindrical pillar portion 47 as shown in FIG. 2.

Figure 4:
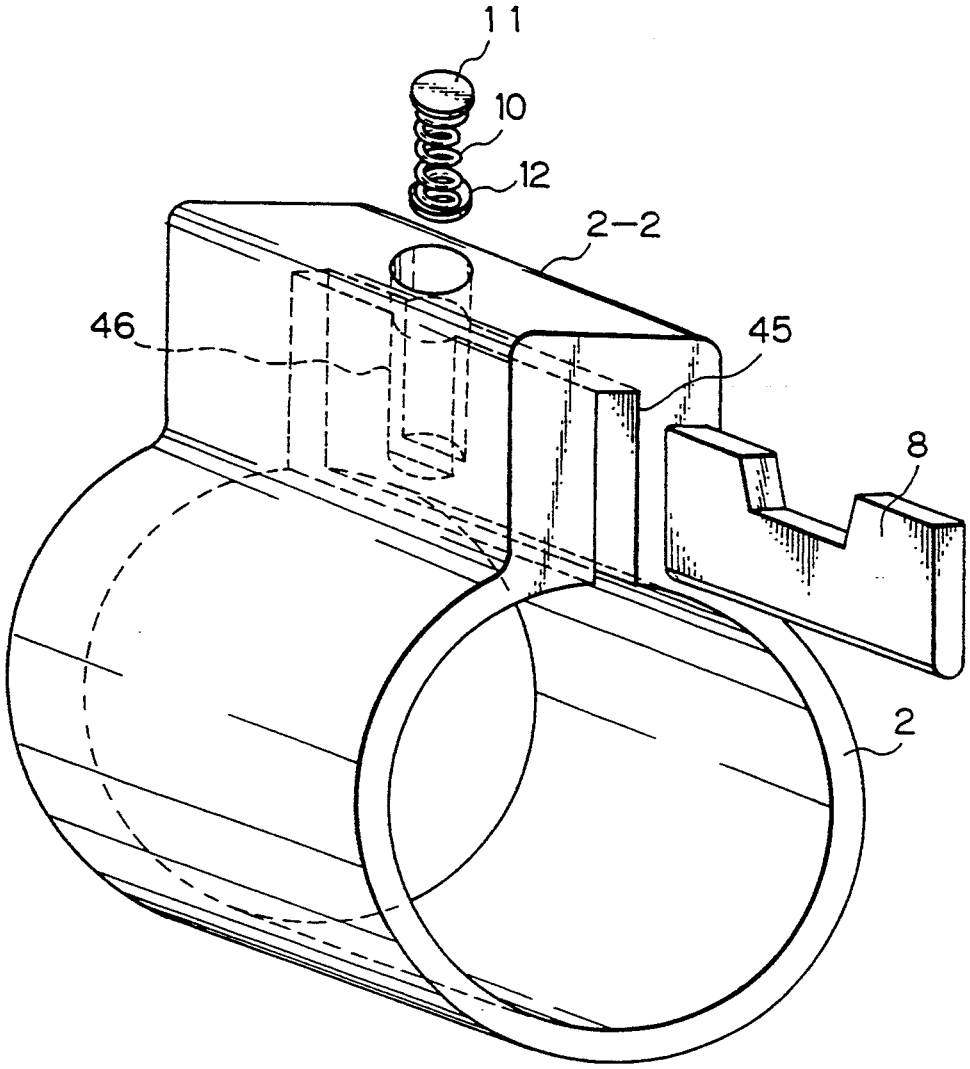
FIG. 4 is a dismantled, partial, schematic perspective view of the compressor in FIG. 1, focusing on the middle housing.
Figure 5A:
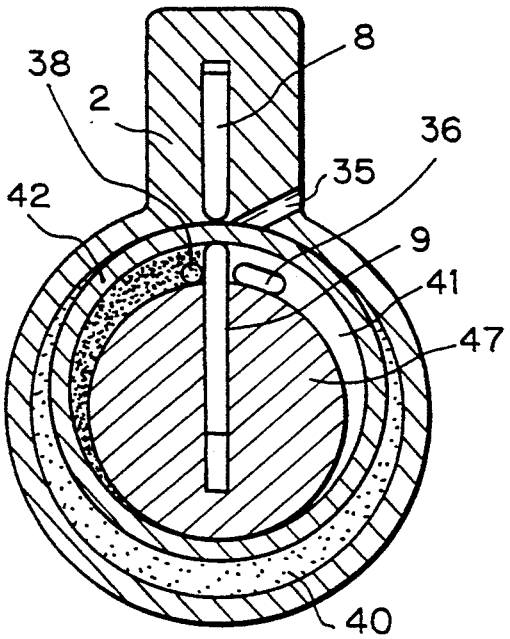
Figure 5B:
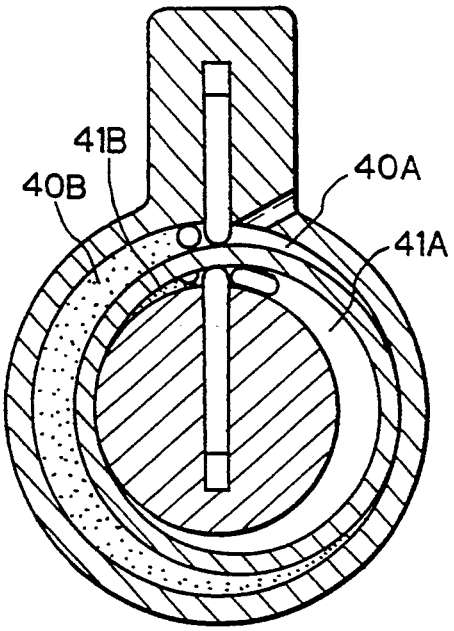
Figure 5D:
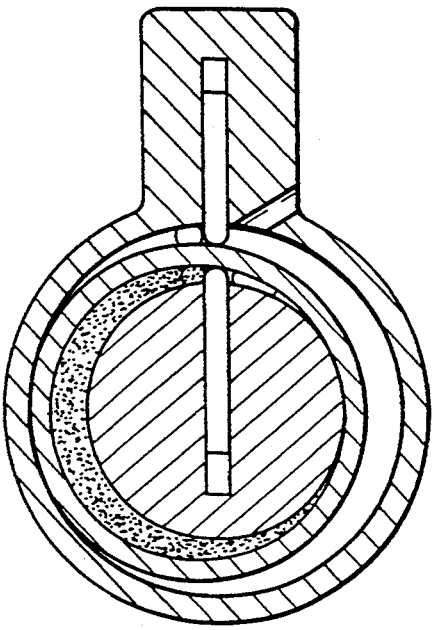
Figure 5C:
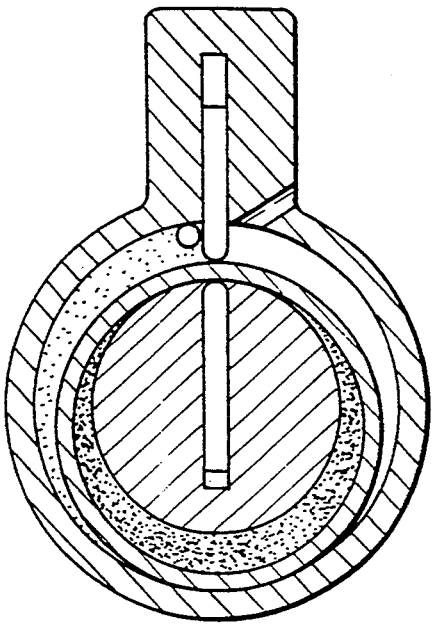

The middle housing 2 forms a guide groove 45 (FIG. 2) which extends radially, and a first vane 8 is slidably inserted into the guide groove 45. As shown in FIG. 4, the middle housing 2 is integrally provided with a radially outwardly extending portion 2-2 which forms a radially extending cylindrical guide opening 46, in which a vane press plate 12 and a coil spring 10 are arranged. The plate 12 is arranged on the outer end of the vane plate 8, and the coil spring 10 rests, at its bottom end, on the retainer plate 12, while a cap member 11 is fixedly connected to the opening 46 by a suitable means such as a screw connection means. The top end of the spring 10 rests on the cap member 11, so that the first vane 8 is urged radially inwardly so that its inner end contacts the outer cylindrical surface of the rolling piston 42.

Figure 3:
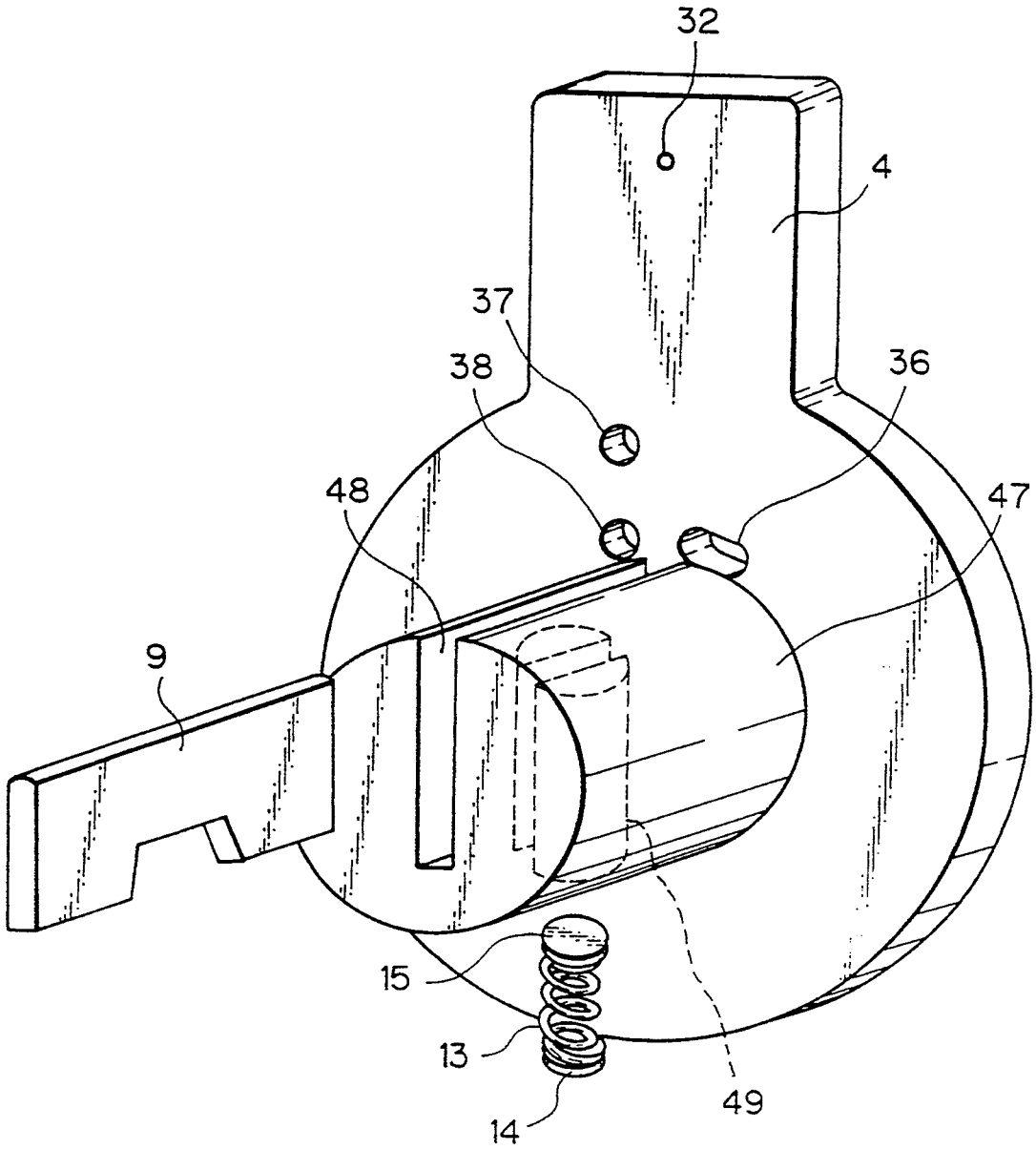
FIG. 3 is a dismantled, partial, schematic perspective view of the compressor in FIG. 1, focusing on the end plate and pillar member.

A radially extending guide groove 48 is also provided for the cylindrical pillar portion 47 as shown in FIG. 3, to which a second vane 9 is radially slidably inserted into the guide groove 48. Furthermore, the pillar portion 47 forms a radially extending spring guide opening 49, in which a vane retainer 15 and a spring 13 are arranged, and a cap 14 is connected to an outer end of the opening 49, so that a spring force is created for urging the second vane 9 so that an end of the vane 9 is contacted with an inner cylindrical surface of the rolling piston 42.

Upon the orbital movement of the rolling piston the first and second vanes 8 and 9 are radially reciprocated in the guide grooves 45 and 48, respectively. In FIG. 2-(A), the rolling piston 42 is in its lowest position (bottom dead center), where the first vane 8 is fully extended, while the second vane 9 is fully contracted. In FIG. 2-(B), the rolling piston 42 is in its highest position (top dead center), where the first vane 8 is fully contracted, while the second vane 9 is fully extended when the rolling piston is rotated to the position as shown in FIG. 2-(A) , the first vane 8 divides the first operating chamber 40 into a first section 40A downstream from the first vane 8 in the direction of the rotation of the rolling piston 42 as shown by an arrow F and a second section 40B upstream from the first vane 8 in the direction of the rotation of the rolling piston 42 as shown by the arrow F. In the position in FIG. 2-(A), the second vane 9 is fully contracted, and therefore the second operating chamber 41 is not divided thereby. Contrary to this, when the rolling piston 42 is rotated to the position in FIG. 2-(B), the rolling piston 42 divides the second operating chamber 41 into a first section 41A downstream from the second vane 9 in the direction of the rotation of the rolling piston 42 as shown by an arrow F and a second section 41B upstream from the second vane 9 in the direction of the rotation of the rolling piston 42 as shown by the arrow F. In the position in FIG. 2-(B), the first vane 8 is fully contracted, and therefore the first operating chamber 40 is not divided thereby. In short, the first and second vanes 8 and 9 are arranged in such a relationship that the timing of the commencement of the compression process is different by 180 degrees between the first and second operating chambers 40 and 41.

For the first operating chamber 40, an inlet port 35 is formed in middle housing 2, and an outlet port 37 is formed in the end plate 4 as shown in FIG. 3. The inlet port 35 and outlet port 37 are located adjacent the first vane 8 so that they straddle a path of movement of the first vane 8. The intake port 35 is opened to the first section 40A of the first operating chamber, while the outlet port 37 is opened to the second section. The intake port 37 is connected to an outlet of an evaporator (not shown) in a refrigerating cycle (not shown) for an air conditioning apparatus (not shown). In FIG. 2-(A) , the rotating movement of the rolling piston 32 in the direction as shown by the arrow F causes the refrigerant gas from the intake port 35 to be sucked into the first section 40A of the first operating chamber 40 due to the fact that the volume of the section 40A is increasing. The rotating movement of the rolling piston 32 in the direction as shown by the arrow F causes the refrigerant gas from the second section 40B of the first operating chamber to be discharged to the outlet port 37 due to the fact that the volume of the section 40A is decreasing.

As shown in FIG. 3, the end plate 4 forms an inlet port 36 and an outlet port 38 for the second chamber 41. The inlet port 36 and outlet port 38 are located adjacent the second vane 9 so that they straddle a trajectory of the movement of the second valve 9. In FIG. 2-(B), the inlet port 36 is opened to the first section 41A of the second operating chamber 41. The outlet port 38 is opened to the first section 41B of the second operating chamber 41. In FIG. 2-(B) , the rotating movement of the rolling piston 32 in the direction as shown by the arrow F causes the refrigerant gas from the intake port 36 to be sucked into the first section 41A of the second operating chamber 41 due to the fact that the volume of the section 41A is increasing. The rotating movement of the rolling piston 32 in the direction as shown by the arrow F causes the refrigerant gas from the second section 41B of the second operating chamber to be discharged to the outlet port 38 due to the fact that the volume of the section 41A is decreasing.

It should be noted that at the position in FIG. 2-(A), the rolling piston 42 closes both the intake port 36 and the outlet port 38 for the second operating chamber 40. At the position as shown in FIG. 2-(B), the rolling piston 42 closes both the intake port 35 and the outlet port 37 for the first operating chamber 40.

Figure 1:
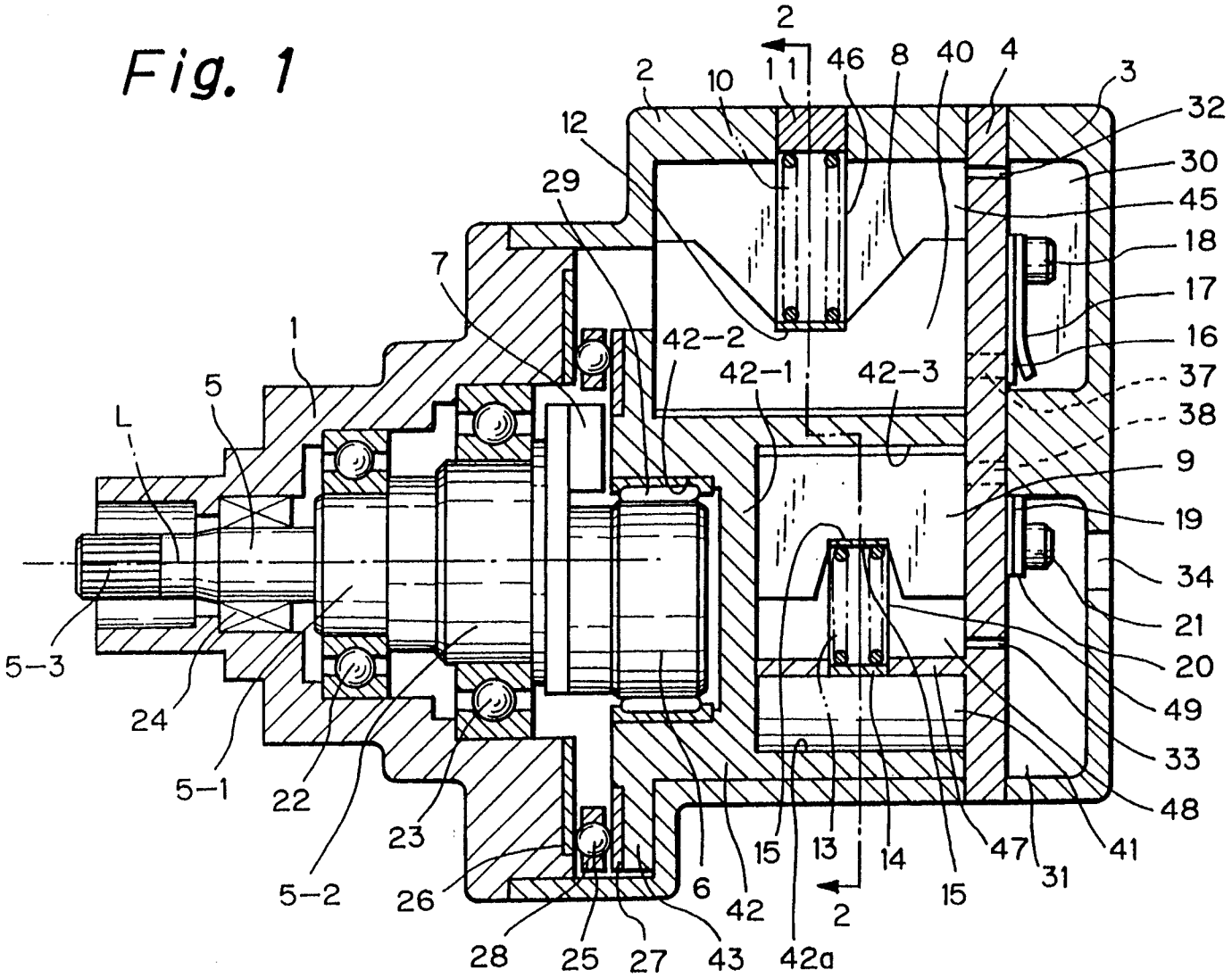

As shown in FIG. 1, the rear housing 3 is connected to the end plate 4 so that an intermediate pressure chamber 30 and outlet pressure chamber 31, which are separated from each other, are created between the housing 3 and the end plate 4. The outlet port 37 of the first operating chamber and the inlet port 41 of the second operating chamber 41 are in communication with the intermediate pressure chamber 30. Thus, the refrigerant gas compressed at the second section 40B of the first operating chamber 40 and discharged to the outlet port 37 is directed into the intermediate chamber 30, and is introduced, via the inlet port 36, to the first section 41A of the second operating chamber 41 for obtaining an additional compression operation. The outlet port 38 of the second operating chamber 41 is opened to the outlet pressure chamber 31. As a result, the refrigerant gas after being subjected to "two stage compression" by the first and second operating chambers 40 and 41 is introduced into the outlet pressure chamber 31.

As shown in FIG. 1, the end plate 4 forms an opening 32 therethrough for communicating the intermediate chamber 30 with the guide groove 45, so that the intermediate pressure in the chamber 30 is opened to the first vane 8, so that a fluid pressure force added to a spring force by the spring 10 is created for urging the first vane 8 to be in contact with the outer cylindrical surface of the rolling piston 42, thereby preventing the refrigerant from being leaked between the first vane 8 and the rolling piston 42. Similarly, the end plate 4 forms an opening 33 therethrough for communicating the outlet pressure chamber 31 with the guide groove 48, so that the outlet pressure in the chamber 31 is opened to the second vane 9, so that the a fluid pressure force added to a spring force by the spring 13 is created for urging the second vane 9 to contact the inner cylindrical surface of the rolling piston 42, thereby preventing the refrigerant from being leaked between the second vane 9 and the rolling piston 42. Note: only one of the spring means (10 and 13) and fluid pressure means (32 and 33) can be used if it provides a sufficient effect of preventing leakage of the refrigerant.

As shown in FIG. 1, a delivery valve 16 as a reed valve together with valve stopper plate 17 is at its one end connected to the end plate 4 on its side facing the intermediate pressure chamber 30 by means of a bolt 18, so that the outlet port 37 is opened or closed. Namely, the valve plate 16 is normally in contact with the end plate 4 by its own resiliency to close the outlet port 37. The pressure in the first operating chamber 40 causes the delivery valve 16 to be detached from the end plate 4 against the resilient force thereof, causing it to be detached from the end plate 4, so that the outlet port 37 is opened for discharging the gas from the operating chamber 40 to the intermediate chamber 30. Similarly, a delivery valve 19 as a reed valve together with valve stopper plate 20 is at its one end connected to the end plate 4 on its side facing the outlet pressure chamber 31 by means of a bolt 21, so that the outlet port 38 (FIG. 1) is opened or closed. Namely, the valve plate 19 is normally in contact with the end plate 4 by its own resiliency to close the outlet port 38. The pressure in the second operating chamber 41 causes the delivery valve 19 to be detached from the end plate 4 against the resilient force thereof, causing it to be detached from the end plate 4, so that the outlet port 38 is opened for discharging the gas from the second operating chamber 41 to the outlet pressure chamber 31. Finally, the rear housing 3 forms a discharge port 34 opened to the outlet pressure chamber 31, on the one hand, and is connected to a condenser (not shown) on the other hand, for supplying the compressed refrigerant thereto.

Now, an operation of the first embodiment will be explained with reference to FIGS. 5-(*a*) to (*d*). FIG. 5-(*a*) shows a condition corresponding to FIG. 2-(B), where the compressor in the first embodiment has just completed its intake stroke, and FIGS. 5-(*b*), (*c*) and (*d*) show a series of positions corresponding to 90, 180, 270 degrees of rotating angle of the rolling piston 42 during one complete orbital movement of the rolling piston 42. It should be noted that the volume of the first operating chamber at the condition of FIG. 5-(*a*) corresponds to an intake volume of the compressor according to the first embodiment. As explained with reference to FIGS. 2-(A) and (B), the first operating chamber 40 is divided into the first and second sections 40A and 40B by means of the first vane 8, while the second operating chamber 41 is divided to the first and second sections 41A and 41B by means of the second vane 9.

The orbital movement of the rolling piston 42 from the condition in FIG. 5-(*a*) to the condition in FIG. 5-(*b*) causes the volume of the second (outlet) section 40B of the first operating chamber 40 to be gradually reduced, whereby the refrigerant therein is compressed so that the refrigerant is discharged, via the outlet port 37, into the intermediate pressure chamber 30, and is sucked via the inlet port 36 into the first (inlet) section 41A of the second operating chamber 41. At the position (c) after the rotation of 180 degrees from the position in FIG. 5-(*a*), the intake stroke to the second control chamber 41 is completed, then a reduction of the volume of the chamber 41 is commenced, so that the refrigerant is further compressed when the rolling piston 42 is rotated to the state in FIG. 5-(*d*). When the pressure at the second operating chamber 41 has reached the pressure corresponding to the refrigerant pressure at the condenser in the outside refrigerating cycle (air conditioning apparatus), the outlet valve 19 is opened, so that the refrigerant is discharged into the outlet pressure chamber 38 via the outlet valve 38.

In short, the sucked refrigerant is subjected to a compression process which lasts substantially two complete rotations of the crankshaft 5 (orbital movement of the rolling piston 42). Contrary to this, in the prior art, the compression lasts substantially only one complete rotation of the crankshaft 1. This means that the compression process according to the present invention is done more slowly than is done in the prior art. In addition, according to the present invention, the compression process is done in a two-step manner, which allows the compression ratio at the chambers 40 and 41 to become smaller than that in the prior art rolling piston type compressor, which is effective in reducing a fluctuation in driving torque.

FIGS. 6, 7 and 8 show results of tests done with reference to the first embodiment of the present invention. Namely, in FIG. 6-(A), the abscissa is a rotation angle, and the ordinate is torque under the compression condition wherein the pressure Ps introduced into the first intake port 35 is 2 $kg/cm^2 \times G$, and the outlet pressure Pd of the refrigerant discharged into the outlet pressure chamber 31 is 15 $kg/cm^2 \times G$. Furthermore, the volume ratio $\alpha$ between the first operating chamber 41 and the second operating chamber and the compression start timing $\beta$ at the operating chambers 40 and 41 are determined to be 0.47° and 180°, respectively in such a manner that a torque variation has a minimum value. In FIG. 6-(A), a dotted line $L_1$ shows a torque for the first operating chamber, while $L_2$ is a torque for the second operating chamber. A solid line $L_T$ is a total torque.

FIG. 6-(B) is similar to FIG. 6-(A), but shows a result of the test done with reference to a prior art twin rolling piston compressor including two operating chambers, wherein dotted lines $L_1'$ and $L_2'$ indicate the torque for first and second chambers, while a solid line $L_T'$ indicates total torque. As easily seen, in comparison with the result of the test in the prior art compressor as shown in FIG. 6-(B), the compressor according to the present invention can reduce the torque variation by about 40%.

FIG. 7 shows a relationship between a volume ratio and torque variation for the compressor according to the first embodiment of the present invention for various combinations of the intake pressure Ps and outlet pressure Pd, of the refrigerant, while the timing $\beta$ for the commencement of the compression at the compressor is maintained at 180 degrees. FIG. 8 shows a relationship between the compression ratio and the torque variation when the intake pressure Ps is 2 $Kg/cm^2$ G. In FIG. 8, a dotted curve M is for the prior art, while a solid curve N is for the present invention when the timing $\beta$ for the commencement of the compression of the compressor is 180 degrees and the volume ratio $\alpha$ is 0.44. As will be understood from FIGS. 7 and 8, the volume ratio and the timing $\beta$ for the commencement of the compression can be suitably determined to obtain a desirably decreased torque variation in a wide range of the pressure obtained by the compressor.

Furthermore, in accordance with the requirements for the compressor when it is used, for example, for high compression purposes, a desired combination of the volume ratio and the timing $\beta$ for the commencement of the compression is determined to largely reduce the torque variations.

Furthermore, the present invention is advantageous in that a single rolling piston is sufficient to compress the refrigerant in two operating chambers, which makes the construction simple, on one hand, and to reduce the size and the weight of the compressor, on the other hand.

Other embodiments of the present invention will now be explained. FIGS. 9 and 10 show the construction of the second embodiment, which features the cylindrical pillar portion 47 being provided with a diametrical guide groove 48 therethrough. The second vane is divided into two diametrically opposite sub-vanes 9A and 9B, which are radially slidably inserted into the guide groove 48. Similar to the first embodiment, vane retainer plates 15A and 15B are provided so as to contact the respective inner, facing ends of the vane plates 9A and 9B. A spring 13 is arranged between the retainer plates 15A and 15B to urge them so that the vane plates 15A and 15B contact, at their respective outer ends, the inner cylindrical surface of the rolling piston 42 with a desired force. As shown in FIG. 10, the sub-vane 9B, which is spaced from the first the vane 8, forms a recess 50 at its outer end facing the inner cylindrical surface of the rolling piston 42. The recess 50 together with the inner cylindrical surface of the rolling piston forms a passageway 50A for communicating spaces on the opposite sides of the sub-vane 9B with each other. The refrigerant confined in the operating chamber 41 can freely pass through the passageway 50A. As a result, the refrigerant in the operating chamber 41 is prevented from being compressed by the sub-vane 9B. According to the second embodiment, the division of the second vane in the cylindrical pillar 47 can reduce the deformation of the spring 13, while maintaining the displacement of the vanes 9A and 9B for the same level. The small deformation of the spring can prolong the service life of the spring, which is effective when the compressor is such a type that the intake volume thereof is relatively small, and the diameter of the cylindrical pillar portion 47 is small.

FIG. 11 shows a third embodiment. In comparison with the first embodiment wherein the crank member 6 is integrally formed with respect to the crankshaft 5, the embodiment in FIG. 11 features the crank member 6 being made as a separate piece from the crankshaft 5. Namely, a crank pin 51 extends axially from the end surface of the portion 5-2 of the crankshaft along a location axially spaced from the rotating axis L of the crankshaft 5, and is fixedly connected to the crankshaft 5. A crank member 6 is formed with an axially extending bore 6-1 therethrough, to which the crank pin 51 is inserted, so that the crank member 6 is rotatable with respect to the crank pin 51. A circlip 52 is provided at an end of the crank pin 51 projected out of the bore 52, which engages with a shoulder portion created at the end of the bore 52, so that the crank member 6 is prevented from being accidentally withdrawn. The crank member 6 is provided with a radially extending portion 6-2, to which a balance weight 7 is connected.

The third embodiment in FIG. 11 will operate the same way as the first embodiment in FIG. 1, if the axis M of the crank pin 51 coincides with the axis L of the crankshaft 5. A desired selection of the location of the crank pin 51 (location of the axis M) can, however, generate a reaction force having a component acting on the rolling piston 42 upon the compression of the refrigerant, so that the rolling piston 42 is urged so as to be, under a suitable force, in contact with the inner surface of the cylinder bore 2-1 of the housing 2, on one hand, and with the outer surface of the cylindrical pillar 47, on the other hand. As a result of such an arrangement, a leakage of the refrigerant being compressed is prevented, which will otherwise occur between the rolling piston 42, the cylinder bore 2-1, and the cylindrical pillar portion 47, thereby increasing the compression efficiency.

FIGS. 12 and 13 show a fourth embodiment. In FIG. 12, a refrigerating circuit 500 is shown, in which the rolling piston type compressor 502 of the same construction as shown in FIG. 1, a condenser 504 as an outside heat exchanger, an expansion valve 506 suitably constructed by a capillary tube, and a condenser 70 as an inner heat exchanger are located. The evaporator 70 is arranged in a duct 508, which has a first end for introduction of air and a second end opened to a cabin of the vehicle subjected to an air conditioning. A fan 510 is arranged in the duct 508 for creating an air flow in the duct 508 to be discharged into the cabin. A fan 512 is arranged so as to face the condenser 504. The evaporator 70 is connected to the inlet port 35 (FIG. 13) for introducing a gaseous refrigerant into the first chamber 40 of compressor 502, while the condenser 504 is connected to the outlet port 34 for receiving the refrigerant gas after compression. As is well known, the gaseous refrigerant compressed at the compressor 502 is received by the condenser 504, whereat the refrigerant is liquidized, while the heat as generated is emitted to the atmosphere with the aid of the outside fan 512. The pressure of the liquid state refrigerant is reduced at the expansion valve 506. The refrigerant of the reduced pressure is gasified at the evaporator 70, while the heat is removed from the air passing the duct 508 for reducing the temperature of the air flow to the cabin.

As shown in FIG. 12, in addition to the refrigerating circuit 500, a by pass passageway 520 is provided, which has an upstream end connected to the refrigerating cycle at a location between the evaporator 70 and the inlet port 35, and a downstream end connected to the intermediate pressure chamber 30 via an opening 61 formed in the casing 3. Arranged on the by-pass passageway 520 is a control valve 60 for controlling an effective volume of the first operating chamber 40. Namely, when the control valve 60 is in a closed condition, all of the refrigerant from the condenser 70 is introduced into the intake port 35 of the compressor, so that the volume of the operating chamber 40 is, itself, an intake volume of the compressor. When the control valve 60 is in an opened condition, the gaseous refrigerant from the evaporator 70 is directed directly to the intermediate chamber 30 via the by-pass passageway and to the second operating cheer 41. In this opened condition of the control valve 60, the intermediate chamber 30 is under an intake pressure. Namely, the first operating chamber does not function to compress the refrigerant, and the intake volume of the compressor corresponds to the volume of the second operating cheer 41. In short, two step changes in the volume of the compressor are obtained by the "ON-OFF" control of the control valve 60, so that an effective use of a driving power is realized in accordance with the cooling requirement. Namely, when a load of the refrigerating cycle is high, the control valve 60 is closed to obtain a large compression capacity. Contrary to this, when the load of the refrigerating cycle is small, the control valve 60 is opened to decrease the compression capacity, so that the driving power is saved.

In order to obtain a desired operation of the control valve 60, the control valve 60 is constructed as an electro-magnetic valve, and a sensor 71 is provided for detection of the temperature of the air after contacting the evaporator 70. The temperature sensor 71 is connected to a control circuit 72, by which the control valve 60 is controlled in accordance with the temperature of the refrigerant sensed by the temperature sensor 71. Namely, when the temperature of the air after contacting the evaporator 70 is lower than a predetermined value of, for example, 3° C., the control circuit 72 issues a signal to make the control valve 60 open, so that an effective capacity of the compressor is reduced to half, which prevents the evaporator 70 from being excessively cooled, on one hand, and causes the power consumption of the evaporator 70 to be reduced, on the other hand. When the temperature of the air after contacting the evaporator 70 is higher than the predetermined value, the control circuit 72 issues a signal to close the control valve 60, so that an effective capacity of the compressor is increased to 100% capacity, so that an increased cooling performance is obtained. In short, the two step control of the capacity of the compressor can reduce the power consumption, while obtaining a desired compression performance.

In the embodiment in FIGS. 12 and 13, in place of detecting the outlet air temperature at the evaporator 70, the intake pressure of the refrigerant (pressure of the gaseous state refrigerant) can be detected for controlling the compression capacity of the compressor. In this case, in place of the electromagnetic valve as the control valve 60, a relief valve of a purely mechanically operated type can be employed. Namely, such a relief valve will be provided with a pressure responding member, such as a diaphragm, which is displaced in accordance with the intake pressure of the refrigerant into the compressor. The relief valve as the control valve 60 is constructed such that it moves from its normally closed condition to an opened condition when the intake pressure is decreased to be lower than a predetermined value of, for example, 2 $Kg/cm^2$.

In the above embodiments, the first stage compression is executed at the first operating chamber 40 located radially outwardly of the rolling piston 42, and the second stage compression of the refrigerant compressed at the first chamber 40 is executed, via the intermediate pressure chamber 30, at the second operating chamber 41 located radially inwardly of the rolling piston 42. An arrangement can, however, be employed, where the first stage compression is executed at the second operating chamber 41 located inwardly of the rolling piston 42, and the second stage compression is executed at the first operation chamber 40 located outwardly of the rolling piston 42.

In the above mentioned embodiments, the thrust bearing constructed by the balls 25, the ball retainer 28, and the thrust receiving plates 26 and 27 is employed for receiving a thrust force generated by the rolling piston 42. The compressor according to the present invention can, however, be constructed without employing such a thrust bearing as will explained hereinbelow.

In a fifth embodiment shown in FIG. 14, the middle housing 2 is formed with an end wall 43' extending radially, while the rolling piston 42 is formed with axially spaced opposite end surfaces **42*b* and 42*c*, which are closely faced with the opposite inner surfaces of the end plate 4 and the wall 43' of the middle housing 2 at respective clearances of a value such as 20 μm, which is effective to prevent a substantial leakage from occurring via these clearances. Furthermore, a combination of a material for constructing the rolling piston 42 as a moving part, and of a material for constructing the middle and end housings 2 and 4 as a stationary part is such that a frictionless sliding movement is obtained. The rolling piston 42 is, for example, made from an aluminum alloy, while the middle housing 2 and end plate 4 are made from a hardened steel. Alternatively, the rolling piston 42 and the middle and end housings 2 and 4 are made from the same material, but surface treatment is applied to a respective sliding surface to obtain a desired frictionless movement between the rolling piston 42 and the middle and end housings 2 and 4. In this latter case, the piston 42 and the middle and end housings 2 and 4 are made from an aluminum alloy, and the rolling piston 42 is, entirely or at least the sliding end surfaces 42*b* and 42*c*, subjected to a plating of a material such as one based on nickel and boron, so that a desired sliding movement is obtained between piston 42 and the middle and end housings 2 and 4**.

In the embodiment in FIG. 14, as explained above, the thrust force generated in the rolling piston 42 is received by the portion 43' of the middle housing 2, facing the end surface **42*c* of the rolling piston 42 or by the end plate 4 facing the end surface 42*b* of the rolling piston 42. Such a construction for receiving the thrust force does not cause problems such as burning. Namely, a small diameter of the orbital movement of the rolling piston 42 and a rotating movement of the rolling piston 42 about its own axis can allow for a speed of the sliding movement of the end surfaces 42*b* and 42*c* of the rolling piston 42 with respect to the end plate 4 and the middle housing 2 to be small, on one hand, and a combination of the materials for constructing the sliding parts, that are the rolling piston 42 and the housing 2 and 4, is selected, or surface treatment is carried out in order to provide a smooth sliding movement, on the other hand. Thus, a thrust bearing can be eliminated without providing any problem such as burning. The elimination of the thrust bearing is also advantageous since the construction is simplified and the axial dimension is reduced. Furthermore, the axial distance between the bearing 29 for supporting the rolling piston 42 with respect to the crankshaft 5 and the bearing 23 for supporting the crankshaft 5 with respect to the front housing 1 is reduced when compared with that in the first embodiment in FIG. 1, which causes the load applied to the bearings 22 and 23 in the front housing 1** to be reduced, thereby enhancing their service life.

The fifth embodiment in FIG. 14 operates in the same manner as that in the 1st to 4th embodiments, and therefore its detailed explanation will be omitted.

FIG. 15 shows a sixth embodiment which is a modification of the 5th embodiment in FIG. 14. The rolling piston 42 is, at the end opposite the end plate 4, a wall portion 42-1 and a tubular portion 42-4 which extends from the surface of the wall portion 42-1 remote from the end plate 4. The crank portion 6 is housed in the tubular portion 42-4 via the bearing member 29. The wall portion 42-1 is further formed, at the outer end surface, with an annular recess 81 located around the tubular portion 42-4, so that the recess 81 is always opened to the opposite surface of the annular end wall portion 43' of the middle housing 2. The front housing 1 forms an opening 84 opened to a back pressure chamber 530 inside the housing 84, while the opening 84 is in communication with the middle pressure chamber 30 via a conduit 83 and an opening 82 formed in the rear housing 3. According to this embodiment, the chamber 530 inside the front housing 1 is under a medium pressure, which acts on the rolling piston 42 at the end wall portion 42-1, causing a force to be generated to move the rolling piston 42 in the right hand direction in FIG. 15, against the thrust force as applied to the rolling piston 42. As a result, a reduction of the thrust force in the left hand direction in FIG. 15 is obtained. Thus, irrespective of an elimination of the thrust bearing in the embodiment in FIG. 15, a smooth sliding movement of the rolling piston 42 with respect to the wall portion 43' of the middle housing is obtained for a longer service period. In the embodiment in FIG. 15, the chamber 530 is opened to the medium pressure in the chamber 30.

Alternatively, a pressure control valve may be provided which controls, selectively, a communication of the chamber 530 inside the front housing 1 with outlet pressure, medium pressure or intake pressure in such a manner the chamber 530 is under a desired pressure. FIG. 16 shows an example of such an embodiment, wherein a pressure control valve 90 is formed as a three-way valve, which has a diaphragm 93, and which forms on one side a chamber 93-1 opened to the atmosphere via an opening 98, and on the other side, a chamber 93-2 opened to the outlet pressure chamber 31 via an opening 100 and a conduit 101. A spring 94 is arranged in the chamber 93-1 for urging the diaphragm upwardly. A push rod 92 is slidably inserted into a valve housing, and a spring 96 is provided for urging the push rod 92 downwardly, so that the push rod 92 contacts the diaphragm 93 at its upper surface. A ball valve 91 is arranged between a pair of spaced apart valve seats 97A and 97B, and is integrally connected to the top end of the push rod 93, so that the ball 91 and the push rod 92 move together. The valve housing is formed with a first port **95*a* connected, via a conduit 102 and an opening 84, to a chamber 530 inside the front housing 1, a second port 95*b* connected to the output pressure chamber 31 via a conduit 101 and an opening 100, and a third port 95*c* connected to the intermediate chamber 30 via a conduit 103 and an opening 82. The ball 91 is, in accordance with the balance of the force applied to the diaphragm 93, for switching between a position where the first port 95*a* is connected to a second port 95*b* and a second position where the first port 95*a* is connected to the third port 95*c***.

Now, the operation of the seventh embodiment in FIG. 16 will be explained. Applied to the diaphragm 93 is a downwardly directed force as a combination of a fluid force generated by the outlet pressure at the chamber 93-2 and the spring force of the spring 96, and an upwardly directed force by the spring 94. The balance of these downwardly and upwardly directed forces cause the diaphragm 93 to move upwardly or downwardly. Such an upward or downward movement of the diaphragm 93 causes the ball valve 91 to be moved upwardly or downwardly for connecting the first port **95*a* with the second port 95*b* or third port 95*c*. Namely, in FIG. 16, when the outlet pressure at the outlet pressure chamber 31 is high, the combined fluid force is larger than the force of the spring 94, which causes the diaphragm 93 to move downwardly, so that the ball 91 closes the valve seat 97A, so that the first port 95*a* is disconnected from the third port 95*c* and is connected to the second port 95*b*. As a result, the outlet pressure in the outlet pressure chamber 31 is opened, via the conduit 101, the ports 95*b* and 95*a*, and the conduit 102, to the chamber 530 inside the front housing 1. Contrary to this, when the outlet pressure at the outlet pressure chamber 31 is low, the combined fluid force is smaller than the force of the spring 94, which causes the diaphragm 93 to move upwardly, so that the ball 91 closes the valve seat 97B, so that the first port 95*a* is disconnected from the second port 95*b* and is connected to the third port 95*c*. As a result, the intermediate pressure in the intermediate pressure chamber 30 is opened, via the conduit 103, the ports 95*c* and 95*a*, and the conduit 102, to the chamber 530 inside the front housing 1**.

As explained above, the seventh embodiment in FIG. 16 allows the pressure in the back pressure chamber 530, which generates a force acting to the end wall portion 80 of the rolling piston 42 to be opposite the thrust force applied thereto, to be changed between the high pressure and the low pressure in accordance with the pressure in the outlet chamber 31. Namely, higher the outlet pressure, higher the pressure in the back pressure chamber 530. As a result, a pressure producing a force matched to the thrust force is generated in the back pressure chamber 530. As a result, an effective cancellation of the thrust force as generated in the rolling piston 42 upon the compression operation being obtained, which allows the reliability of operation as well as a prolonged service life.

FIGS. 17 to 19 shows an 8th embodiment according to the present invention. According to this embodiment, between axially end surfaces **42*b* and 42*c* of the tubular portion of the rolling piston 42 and the end plate 4 and the end plate portion 43' of the middle housing 2, sliding plates 110 (FIG. 18) and 111 (FIG. 19) made of a material providing a smooth sliding movement such as a polished strip of steel, are respectively arranged. Namely, as shown in FIG. 18, the sliding plate 110 is constructed by a ring shaped portion 110-1, a strip portion 111-2 which extends radially outwardly so as to contact the first vane 8 at its rear side edge when the first vane 8 reciprocates radially in the first guide groove 45, and a strip portion 110-3 which extends radially inwardly so as to contact the second vane 9 at its rear side edge when the second vane 9 reciprocates radially in the second guide groove 48. As shown in FIG. 19, the sliding plate 111 is constructed by a ring shaped portion 111-1, and a strip portion 110-2 which extends radially outwardly so as to contact the first vane 8 at its front side edge when the first vane 8 reciprocates radially in the first guide groove 45. In addition, a sliding plate 112 made of a similar material is also arranged between the inner end surface of the piston and the axial end surface of the tubular pillar portion 47 of the end plate 4. According to the 8th embodiment, even in the case where the rolling piston 32, the end plate 4 and the middle housing 2, which are subjected to a sliding movement, are made from the same material such as an aluminum alloy, surface treatment is eliminated, while providing a desired slide movement. The slide plates 110, 111 and 112** are not necessarily all provided. Namely, some of them can be eliminated, so long as a desired frictionless sliding movement is obtained.

FIGS. 20 and 21 show a 9th embodiment of the present invention, wherein the rolling piston 42 is formed, at its opposite end surfaces **42*a* and 42*b*, with annular recess for receiving ring shaped seal members 113 and 114, respectively, made of a material such as a certain kind of resin for allowing a desired smooth sliding movement. The provision of the ring shaped seal members 113 and 114 can prevent the refrigerant from being leaked, thereby increasing compression efficiency. Furthermore, a variation in clearance between the end surfaces 42*b* of the cylindrical portion of the rolling piston 42 and the end plate 4**, and between the end surface 42*b* of the cylindrical portion of the rolling piston 42 and the end plate 43′ of the middle housing 2, which is inevitable, does not cause the compression efficiency to vary. Namely, a compressor with less variation in compression efficiency can be obtained.

The above described 5th to 9th embodiments are directed to an elimination of a thrust bearing for the rolling piston 42. Next, an improvement for eliminating an unnecessary consumption of power for driving the compressor when the thermal load of the compressor for an automobile is very small, i.e., the outside air temperature is very low, will be explained.

The present invention, as explained with reference to FIGS. 5(*a*) to 5(*d*), features a two stage compression being obtained by the first and second operating chambers 40 and 41. Furthermore, the pressure at the completion of the first stage compression by the first operating chamber 40, referred to herein as an intermediate pressure, is determined from a ratio between the volumes of the first and second operating chambers 40 and 41. Thus, the volume ratio is determined for obtaining a reduced variation of the torque under a usual thermal load condition. However, when the thermal load is extremely reduced, the pressure for condensation at the refrigerating cycle is reduced in such a manner that the outlet pressure of the compressor is lower than the intermediate pressure. In this case, a situation may arise where the refrigerant excessively compressed at the first stage operating chamber 40 is expanded at the second stage operating chamber 40, thereby causing a substantial part of the driving power to be wasted.

According to the 10th embodiment in FIGS. 22 and 23, in order to combat the above mentioned problem, the rear housing 3 forms a by-pass port 120 having one end opened to the intermediate pressure chamber 30 and a second end opened to the outlet pressure chamber 31 via a check valve 121 as a reed valve. As shown in FIG. 23, the check valve (reed valve) 121 together with valve stopper 122 are, at their ends, connected to the housing 3 by means of a bolt 123. The check valve 121 allows a flow of the refrigerant from the intermediate pressure chamber 30 to the outlet pressure chamber 31, while preventing the flow from the outlet pressure chamber 31 to the intermediate pressure chamber 30. As a result, a first and second compression passageways are created. Namely, according to the first compression passageway, the refrigerant as compressed in the first operating chamber 40 flows, via the outlet port 37, the intermediate chamber 30, the intake port 36, the second operating chamber 41 and the outlet port 38, into the outlet chamber 31. According to the second compression passageway, the refrigerant as compressed in the first operating chamber 40 flows, via the outlet port 37, the intermediate chamber 30 and the intake by-pass port 120, into the outlet chamber 31. An arrangement of the first and second vanes 8 and the second vane 9 is such that a 180 degree difference in the timing for starting the compression exists between the first and second operating chambers 40 and 41.

Now, the operation of the 10th embodiment in FIGS. 22 and 23 will be explained. When the thermal load in the refrigerating cycle is of a value within a normal load range, the operation as explained with reference to FIGS. 5 to 8 is also obtained. Namely, the intermediate pressure (the pressure at the chamber 30) is obtained by $$Ps \times \left(\frac{1}{\alpha}\right)^{k},$$

where Ps is a pressure of the refrigerant introduced into the intake port 35, $\alpha$ is a volume ratio between the first and second operating chambers 40 and 41 and k is a specific heat. When the intake pressure Ps=2 kg/cm$^2$ G, the volume ratio $\alpha$=0.47, and k=1.14, the value of the intermediate pressure calculated from the above equation is about 6.1 kg/cm$^2$ G. Under a usual thermal load condition, the output pressure at the chamber 31 is higher than the intermediate pressure in the chamber 30, which causes the check valve 121 to assume a closed position to close the by-pass port 120. As a result, the above mentioned two stage compression operation by the first and second operating chambers 40 and 41 is obtained.

Now, an operation will be explained when the thermal load is very low. In this case, the pressure at the outlet of the condenser in the refrigerating cycle is also low, so that a situation may arise where the output pressure at the outlet pressure chamber 31 is lower than the pressure at the intermediate pressure chamber 30. In such a situation, the two stage compression causes the driving power to the compressor to be wasted due to the fact that the refrigerant compressed to the intermediate pressure at the first operating chamber 40 is subjected to an expansion at the second operating chamber 31. In contrast, according to the 10th embodiment in FIG. 22, when the pressure at the output pressure at the chamber 31 is lower than the pressure at the intermediate pressure at the chamber 30, the check valve 121 assumes an open position, so that the refrigerant gas in the intermediate pressure chamber 30 flows into the outlet pressure chamber 31, so that the pressure is equalized between the chambers 30 and 31, so that over compression in the first chamber 30 is prevented. Namely, the refrigerant in the first operating chamber 30 is compressed to a pressure which just corresponds to the outer pressure, and is discharged, via an outlet port 37, the chamber 30, and the by-pass port 120, to the outlet pressure chamber 31. Furthermore, the refrigerant in the intermediate pressure chamber 30 is sucked into the second operating chamber 41, so that, in the second chamber 41, the intake pressure and the outlet pressure are equalized, so that the work done at the second operating chamber is nullified, thereby preventing drive power from being unnecessarily wasted. In this mode, a single stage compression is obtained, which can, however, maintain a small variation in the torque because the compression ratio is small due to the fact that the output pressure is relatively low.

FIGS. 24 and 25 show 11th embodiment, which is a slight modification of the 10th embodiment. Namely, a check valve 130 is arranged on a partition wall 3-1 of the rear housing 3, which separates the intermediate pressure chamber 30 and the outlet pressure chamber 31 from each other. As shown in FIG. 25, the check valve 130 is constructed by a casing 131 defining an inner valve seat 135 of conical shape which is, at its first, narrow end, connected to the intermediate chamber 30 via an opening 135*a*, and is, at its second, wider end, opened to the outlet pressure chamber 31, a ball shaped valve 132 facing the valve seat 135, a spring 133 for urging the ball valve 132 to seat the valve seat 135, and a spring seat 134 of annular shape, which is, at its outer periphery, fitted to an annular recess formed at the inner wall of the casing 131. The force of the spring 133 is such that the ball valve 132 can maintain its usual state where the ball valve 132 is seated on the valve seat 135 irrespective of outer disturbance, such as a vibration of the vehicle while running. It should be noted that the casing 131 forms a screw thread portion 131-1 which is screwed to the corresponding screw thread in the wall section 3-1 of the housing 3.

In the operation of the embodiment in FIG. 24, when the intermediate pressure exceeds the outlet pressure, the valve ball 132 is moved downwardly by the intermediate pressure against the force of the spring 133, so that the valve ball 132 is detached from the valve seat 135, which allows the refrigerant in the intermediate pressure chamber 30 to be introduced into the outlet pressure chamber 31, which causes the pressure to be equalized between the chambers 30 and 31. As a result, a similar operation to that in the 10th embodiment in FIG. 22 is realized.

According to the present invention, the lubrication of the parts effecting sliding movement in the compressor is done by a lubrication oil mixed with the refrigerant. Namely, when the refrigerant is introduced into the operating chambers or is discharged therefrom, the lubricant mixed therewith is supplied to various parts executing the sliding movement to provide lubrication thereof. Such a lubrication system can cause, however, some of the parts of the compressor, such as vanes, not to be fully supplied by the lubrication oil due to the fact that a flow of the lubricant is difficult to bring into contact with these portions. Embodiments described hereinafter are directed to an improvement for obtaining a desired lubrication of these parts where the flow of the lubricant is usually difficult to achieve. Namely, FIG. 26 shows a 12th embodiment, wherein a phase separator 145 is provided in the outlet pressure chamber 31 at the location adjacent the outlet port 38. The separator 145 is formed as a plate made of metal or resin material, as shown in FIG. 27. The separator 145 is arranged to face the outlet port 38 in such a manner that the flow of the refrigerant after compression in the second operating chamber 41 is contacted with the separator 145. In order to effectively catch the flow of the refrigerant from the outlet port 38, the separator 145 is formed with a pair of lateral flanks **145*a* and 145*b*, and top flank 145*a* which are inwardly bent. As shown in FIG. 26, a first vane chamber 141 is formed by the spring guide opening 46 in which the first vane spring 10 is arranged and the first vane guide groove 45 in which the first vane 8 is slidably reciprocated, while a second vane chamber 142 is formed by the spring guide opening 49 in which the second vane spring 13 is arranged and the second vane guide groove 48 in which the second vane 9 is slidably reciprocated. The middle housing 2 forms a passageway 143*a* for introducing the lubricant oil to the first vane chamber 141 and a passageway 143*b* for introducing the lubricant oil to the second vane chamber 142. The passageway 143*a* has a first end 143*a*-1 opened to the outlet chamber 31 at the position adjacent the bottom thereof and a second end 143*a*-2 opened to the first vane chamber 141 at its spring guide opening 46. The passageway 143*b* has a first end 143*b*-1 opened to the second vane chamber 142 at its spring guide opening 49 and a second end opened to the passageway 143*a***.

Now, the operation of the embodiment in FIG. 26 will be explained. The phase separator 145 of a plate shape as shown in FIG. 2 is arranged in the outlet pressure chamber 31 adjacent the outlet port 31. Thus, flows of the refrigerant mixed with the lubrication oil after compression from the second operating chamber are discharged to contact the phase separator plate 145. In this case, the lubricant oil mixed with the gaseous refrigerant is attached the surface of the separator plate 145 due to the viscous nature of the lubricant, and is flowed down on the surface of the plate 145 by gravity due to the weight thereof, so that the liquid state lubricant is accumulated at the bottom portion of the outlet pressure chamber 31.

The relationship between the outlet pressure Pd, the intermediate pressure Pi and the intake pressure Ps is such that:

Outlet pressure > Intermediate pressure > Intake pressure

The first vane chamber 141 is under a pressure which is equal to the pressure at the first operating chamber 40 due to the fact that the first vane chamber 141 communicates with the first operating chamber 40 via a clearance between the first vane 8 and the middle housing 2. A relationship between the intermediate pressure, the pressure at the first operating chamber 40 and the intake pressure is such that:

Intermediate pressure > Pressure at first operating chamber > Intake pressure Therefore, the relationship between the intermediate pressure, the pressure at the first vane chamber 141 and the intake pressure is such that:

Intermediate pressure > Pressure at first vane chamber > Intake pressure

Similarly, the pressure at the second vane chamber 142 is equal to the pressure at the second operating chamber 41. As a result, the relationship between the outlet pressure, the pressure at the second operating chamber 41 and the intermediate pressure is such that:

Intermediate pressure > Pressure at second operating chamber > Intake pressure

Therefore, the relationship between the intermediate pressure, the pressure at the second vane chamber 142 and the intake pressure is such that:

Intermediate pressure > Pressure at first vane chamber > Intake pressure

As a result, the highest pressure at the outlet pressure chamber 31 causes the lubricant oil accumulated at bottom thereof to be forced downwardly, which causes the oil to be urged into the oil passageway 143, and to be introduced into the first and second vane chambers 141 and 142. As a result, the first and second vanes 8 and 9 are subjected to a forced lubrication at their portions effecting a slide movement. As will be seen from FIG. 26, the oil passageway 143 is formed with an orifice 140 for applying a desired amount of the lubricant as supplied to the sliding parts.

FIG. 28 shows a 13th embodiment, wherein the first oil passageway **143*a* has an end 143*a*-2' opened to the surface on which the first vane 8 slides, while the second oil passageway has an end 143*b*-1' opened to the surface on which the second vane 9 slides. As a result, the open ends 143*a*-2' and 143*b*-1' are opened or closed with respect to the first and second vane chambers 141 and 142, respectively in accordance with the positions of the vanes 8 and 9, respectively during the reciprocal movement thereof. This embodiment can control the amount of the oil supplied in accordance with the location of the open ends 143a-2' and 143b-1'. Namely, longer the period for opening these open ends, the larger the amount of oil that is fed. As a result, the orifice 140 for controlling the effective flow area for the lubricant oil in the embodiment in FIG. 26** can be eliminated.

FIG. 29 shows a 14th embodiment, wherein a provision is made as to an oil feed passageway 143a' for connecting the intermediate pressure chamber 30 with the first vane chamber 141 and an oil feed passageway 143b' for connecting the outlet pressure chamber 31 with the second vane chamber 142. In addition to the phase separator 145 in the outlet pressure chamber 31, an additional phase separator 146 is provided in the intermediate chamber 30, which allows the lubricant oil separated from a gaseous state refrigerant to be accumulated at the bottom of the chamber 30. The provision of the passageways 143a' independent from the passageway 143b' can provide a reduced pressure difference across the length of the passageway 143b' between the chambers 141 and 30 due to the small pressure in the chamber 30, which is advantageous in that adjustment of the amount of supply of the oil becomes easy, when compared with the construction in FIG. 26, where a pressure difference across the length of the passageway 143a between the chamber 141 and 31 is high due to the high pressure at the outer pressure chamber 31.

FIG. 30 shows a 15th embodiment, which is an improvement of the 14th embodiment in FIG. 29. The rolling piston 42 forms a communication passageway 150 having a first end opened to the second vane chamber 142 and a second end opened to a space 200 formed between the faced end surfaces 42A and 5A of the rolling piston 42 and the shaft 5. The crankshaft 5 forms a communication passageway 151, which has a first end opened to the space 200 and a second end opened to the space 202 between the bearings 22 and 23, and a space 204 between the bearing 22 and the seal 24. Furthermore, the front housing 1 forms a passageway 152 for communicating the space 160 between the bearing 23 and the bearing 29 with the intake port 35.

According to the embodiment in FIG. 30, the bearing chamber 150 is in communication with the intake port 35 via the passageway 152, which causes the pressure at the bearing chamber 152 to be equalized with the pressure at the intake port 35. Thus, a following relationship is obtained, that is:

Outer pressure > Pressure at the second vane chamber 142 > Intermediate pressure > Pressure at the first vane chamber 141 > Intake pressure Therefore, the refrigerant introduced into the second vane chamber 142 from the outlet pressure chamber 31 is introduced, via the communication passageways 150 and 151, to the bearing chamber 160 under a pressure which is equal to the intake pressure. As a result, the bearings 22, 23 and 29 are lubricated at their sliding parts.

The 12th to 15th embodiments are advantageous in that an additional member such as an oil pump can be eliminated, while a mere provision of oil passageways is effective to obtain a desired supply of the oil to a location where no flow of the refrigerant is created by the effect of a pressure difference. Furthermore, the oil mixed in the refrigerant can be effectively separated before it is supplied to various part to be lubricated. Thus, leakage of the refrigerant gas can be minimized.

We claim:

1. A rolling piston type compressor, comprising:

(a) a housing defining a circular cylinder bore defining an inner cylindrical surface;

(b) a shaft having an axis of elongation rotatably supported by said housing, said shaft having a crank member which is eccentric with respect to the axis of the shaft;

(c) a circular cylindrical pillar which is fixed to the housing and which has an axis of elongation which coincides with the axis of the shaft, said pillar forming an outer cylindrical surface;

(d) a rolling piston of a circular tubular shape having an axis of elongation, the rolling piston being connected rotatably to the crank member of the shaft so that an orbital movement of the rolling piston is obtained about the axis of the shaft, said rolling piston having an inner and outer circular cylindrical surfaces, which, during said orbital movement of the rolling piston, stay in contact, respectively, with said outer cylindrical surface of the pillar and said inner cylindrical surface of the housing, so that first and second operating chambers are created between the rolling piston and the housing and between the rolling piston and the pillar, respectively, a value of a volume ratio between said first and second operating chambers being in a range between about 0.4 to about 0.6;

(e) first vane means for dividing the first chamber into first and second sections so that, upon the orbital movement of the rolling piston, the volume of the first section of the first chamber increases while the volume of the second section of the first chamber decreases;

(f) second vane means for dividing the second chamber into first and second sections, so that, upon the orbital movement of the rolling piston, the volume of the first section of the second chamber increases while the volume of the second section of the second chamber decreases, said first and second vane means being arranged in such a relationship that a timing of a commencement of a compression process is different by a value of about 180 degrees between said first and second operating chambers;

(g) an intake port opened to a first section of one of the first and second chambers for introducing a medium to be compressed thereinto;

(h) an intermediate pressure chamber for connecting the second section of said one chamber with the first section of the other chamber for receiving the medium as compressed at the one chamber, and;

(i) an outlet pressure chamber connected to the second section of the other chamber for receiving the medium compressed at the other chamber.

2. A rolling piston compressor according to claim 1, wherein said one chamber is said first chamber, while the other chamber is the second chamber, wherein said first vane means comprises a first vane which is radially slidable with respect to the housing, and means for urging the first vane to contact the outer surface of the rolling piston, and wherein said second vane means comprises a second vane which is radially slidable with respect to the pillar, and means for urging the second vane to contact the inner surface of the rolling piston.

3. A rolling piston compressor according to claim 2, wherein said second vane means further comprises an auxiliary vane which is radially slidable in said pillar at a location diametrically opposite of the second vane, said urging means urging said auxiliary vane so as to contact the inner cylindrical surface of the rolling piston, the auxiliary vane forming a groove which allows the medium in the second operating chamber to freely pass.

4. A rolling piston compressor according to claim 1, wherein said housing includes a first part for rotably supporting the crankshaft, a second part for defining therein said cylindrical bore for storing the rolling piston, the second part having first and second ends and being connected to the first part at the first end, a third part of substantially plate shape contacting the second part at the second end for closing the cylindrical bore, while said pillar is connected to the third part, and a fourth part connected to the third part for creating said intermediate pressure chamber and the outlet pressure chamber therebetween.

5. A rolling piston compressor according to claim 4, wherein said pillar member is integrally formed with respect to said third part of the housing.

6. A rolling piston compressor according to claim 1, wherein said crankshaft is constructed by a shaft member rotably supported by the housing, a crank member which is fitted to the rolling piston, and connecting means for connecting the shaft member with the crank member so as to be rotatable with respect to the shaft member.

7. A rolling piston compressor according to claim 1, further comprising a passageway formed in the housing, having a first end opened to the intake port and a second end opened to the intermediate pressure chamber, and a control valve means arranged on said passageway and responsive to a control signal for selectively closing or opening the passageway in accordance with a requirement as to the capacity of the compressor.

8. A rolling piston compressor according to claim 7, wherein said compressor is adapted for use in a refrigerating cycle for an air conditioning device for a vehicle, and wherein it further comprises means for creating said signal to be supplied to the control valve in accordance with the an air conditioning load of the refrigerating cycle.

9. A rolling piston compressor according to claim 1, wherein said housing has opposite inner surfaces extending transversely to the axis of the crankshaft, while the rolling piston has opposite outer surfaces also extending transversely to the axis of the shaft which face inner surfaces of the housing, respectively, and wherein means are provided between said faced surfaces of the housing and rolling piston for obtaining a desired slide movement of the rolling piston with respect to the housing.

10. A rolling piston compressor according to claim 9, wherein said means for obtaining the slide movement comprise at least one seal ring member arranged between the facing surfaces.

11. A rolling piston compressor according to claim 1, wherein said housing has opposite inner surfaces extending transversely to the axis of the crankshaft, while the rolling piston has opposite outer surfaces also extending transversely to the axis of the shaft which face inner surfaces of the housing, respectively, and wherein said faced surfaces are arranged with a desired gap value, and a combination of the materials for constructing the housing and rolling piston are suitably selected.

12. A rolling piston compressor according to claim 9, wherein the rolling piston forms, at the opposite outer surfaces facing the housing, an annular recess for decreasing a thrust force from the rolling piston to the housing.

13. A rolling piston compressor according to claim 1, wherein said housing has opposite inner surfaces extending transversely to the axis of the crankshaft, while the rolling piston has opposite outer surfaces also extending transversely to the axis of the shaft which face inner surfaces of the housing, respectively and an inner surface extending transversely and facing an outer surface of the pillar, wherein sliding members made of thin wear resistant material are arranged between the facing surfaces of the housing and the rolling member, and between the rolling piston and the pillar.

14. A rolling piston compressor according to claim 13 wherein each of said sliding members is constructed by a ring portion arranged between axially facing surfaces, and at least one radially extending portion contacting a corresponding vane means.

15. A rolling piston compressor according to claim 1, wherein a back pressure chamber is formed inside the housing adjacent the rolling piston on a side thereof opposite the pillar, and wherein the rolling piston compressor further comprises means for controlling pressure in the back pressure chamber thereby controlling a force applied to the rolling piston opposite a thrust force applied to the rolling piston in accordance with a pressure of refrigerant being compressed.

16. A rolling piston compressor according to claim 15, wherein said control means comprises a passageway opened to the intermediate chamber, a passageway opened to the outlet pressure chamber, a passageway opened to the back pressure chamber, and a valve means responsive to the output pressure of the medium for controlling the communication of the back pressure chamber with the intermediate pressure chamber or outlet pressure chamber.

17. A rolling piston compressor according to claim 1, further comprising a passageway connecting the intermediate pressure chamber and the outlet pressure chamber, and a check valve for allowing a flow of the medium from the intermediate chamber to the outlet pressure chamber.

18. A rolling piston compressor according to claim 17, wherein said check valve is constructed as a reed valve.

19. A rolling piston compressor according to claim 17, wherein said check valve is constructed as a spring urged ball shaped valve.

20. A rolling piston compressor according to claim 1, wherein said medium to be compressed is a gaseous refrigerant mixed with lubrication oil for a refrigerating cycle, and wherein the rolling piston compressor further comprises a separator arranged in the outlet chamber for separating, due to the difference in a viscosity, liquid state oil from the gaseous state refrigerant in the outlet pressure chamber.

21. A rolling piston compressor according to claim 20, wherein said housing forms passages having a first end opened to the outlet pressure chamber below a level of oil therein and second ends opened to the locations where the slide movement of the vanes is obtained, thereby providing lubrication of the vanes.

22. A rolling piston compressor according to claim 21, wherein the second ends of the oil passageways are selectively opened or closed upon a stroke movement of the respective vanes for controlling the amount of oil supplied.

23. A rolling piston compressor according to claim 20, further comprising a second separator arranged in the intermediate pressure chamber for separating liquid state oil from the gaseous state refrigerant in the outlet pressure chamber.

24. A rolling piston compressor according to claim 21, wherein bearing members are provided for supporting the crankshaft with respect to the housing, and wherein the compressor further comprises passageways for the oil separated at the outlet pressure chamber, the passageways extending from the location where the slide movement of the vane is obtained to locations adjacent to the bearing members.

* * * * *